US006582766B2

(12) United States Patent
Yamada et al.

(10) Patent No.: US 6,582,766 B2
(45) Date of Patent: Jun. 24, 2003

(54) TWO-TONE COATING METHOD

(75) Inventors: Shiro Yamada, Shimada (JP); Michio Mitsui, Yokohama (JP); Shinichi Takayama, Kakegawa (JP)

(73) Assignee: ABB K.K., Tokyo (JP)

( * ) Notice: Subject to any disclaimer, the term of this patent is extended or adjusted under 35 U.S.C. 154(b) by 0 days.

(21) Appl. No.: 10/049,652

(22) PCT Filed: Jun. 19, 2001

(86) PCT No.: PCT/JP01/05221

§ 371 (c)(1),
(2), (4) Date: Feb. 26, 2002

(87) PCT Pub. No.: WO02/00357

PCT Pub. Date: Jan. 3, 2002

(65) Prior Publication Data

US 2003/0017276 A1 Jan. 23, 2003

(30) Foreign Application Priority Data

Jun. 26, 2000 (JP) ..... 2000-191811

(51) Int. Cl.[7] ..... B05D 1/36

(52) U.S. Cl. ..... 427/261; 427/258; 427/284; 427/287; 427/484

(58) Field of Search ..... 427/484, 421–427, 427/256, 258, 261, 282, 284, 287

(56) References Cited

U.S. PATENT DOCUMENTS 4,138,284 A * 2/1979 Postupack
4,208,446 A * 6/1980 Postupack et al.
4,740,384 A * 4/1988 Meisner et al.
5,079,030 A * 1/1992 Tomioka et al.

FOREIGN PATENT DOCUMENTS

| | | |
|---|---|---|
| JP | 58058168 | 4/1983 |
| JP | 62-097671 | 5/1987 |
| JP | 8-155386 | 6/1996 |
| JP | 9-047694 | 2/1997 |
| JP | 11057606 | 3/1999 |

* cited by examiner

*Primary Examiner*—Fred J. Parker
(74) *Attorney, Agent, or Firm*—Oblon, Spivak, McClelland, Maier & Neustadt, P.C.

(57) ABSTRACT

In a color A area coating stage, color A paint is coated on a vehicle body (12) to form a color A coating (PA). In a next border zone coating stage, a border zone coating (PB1) is formed by means of a rotary atomizing head type sprayer unit (31) which is tilted with respect to a coating surface of the vehicle body (12) and adapted to spray color B paint toward the vehicle body (12) solely by centrifugal force. In a succeeding belt zone coating stage, a belt zone coating is formed continuously from the border zone coating (PB1) by means of a tilted rotary atomizing head type sprayer unit. In a next remainder area coating stage, a remainder area coating is formed on remaining areas of the coating surface continuously from the belt zone coating. By these arrangements, sprayed color B paint particles are allowed to deposit and settle on the vehicle body (12) without rebounding when applying the border zone coating (PB), forming a clear and well-defined border line (BL).

27 Claims, 27 Drawing Sheets

Fig. 15

| COATING AREA | COATING DISTANCE (mm) | INCLINATION ANGLE (°) | MIST BLOCKING AIR | SHAPING AIR | HIGH VOLTAGE (kV) |
|---|---|---|---|---|---|
| COLOR A AREA a | 200～350 | 0 | NOT SUPPLIED | SUPPLIED | -30～-120 |
| BORDER ZONE b | 5～20 | 50～80 | SUPPLIED | NOT SUPPLIED | 0～-10 |
| BELT ZONE c | 5～40 | 50～80 | SUPPLIED | SUPPLIED (IN SUPPRESSED AMOUNT) | 0～-30 |
| REMAINDER AREA d | 100～350 | 0～10 | SUPPLIED AT SUITABLE RATE | SUPPLIED | -30～-120 |

TWO-TONE COATING METHOD

TECHNICAL FIELD

This invention relates to a method for coating a work object in two tones, particularly for coating surfaces of a work object such as a vehicle body or the like in two tones.

BACKGROUND ART

Generally speaking, coating machines which are currently in use in the art are largely constituted by a coating action mechanism like a coating robot which is located in a coating booth, and a paint sprayer unit which is adapted to spray atomized paint particles toward a work object. In the case of coating vehicle bodies, for instance, when a work object is delivered to a coating booth by means of a work object transfer system, paint is sprayed toward the work object from a sprayer unit which is mounted on an arm distal end portion of a coating robot to move the sprayer unit along coating surfaces of the work object, keeping a predetermined distance from the latter.

In this connection, as is well known in the art, in addition to coating in one and single color, the so-called two-tone coating is often resorted to in painting vehicle bodies, for example, coating an upper half of a vehicle body in one color and a lower half in a different color.

More specifically, according to a prior art two-tone coating method, as shown in the block diagram of FIG. 35, an upper half of a vehicle body is coated with a first color, for example, by the use of paint of color A (Step 1), a clear paint is coated on the surface of the coating of color A (Step 2), and the vehicle body is put in a baking furnace to cure the coated films (Step 3). In the next place, masking tapes are put on the vehicle body along borders of the coated area, masking the coated area of color A to prevent deposition of a second color, namely, to prevent deposition of paint of color B on the color A area (Step 4). After masking the color A area, the color B is coated on the lower half of the vehicle body in such a way as that upper portions of the color B area partly overlaps the color A area (Step 5). A clear paint is then coated on the coated color A (Step 6), and the vehicle body is put in the baking furnace again to cure the coated films (Step 7), followed by removal of the masking tapes (Step 8). The removal of masking tapes reveals two coated areas of different colors (two tones) which are clearly separated from each other by a border line.

In the case of the above-described two-tone coating method, however, coated films of the second color B are forcibly stripped off together with the masking tapes at the time of removal of the latter, leaving a stepped surface along border lines between the color A and color B areas. In addition, upon peeling off masking tapes, fine sawtooth-like notches appear continuously along bordering edges of the color B area to degrade the quality of finish coating to a considerable degree.

The masking involves the jobs of sticking masking tapes and sheet on and over a masking area and peeling off the masking tapes and sheets afterwards. Because of the difficulty of performing these jobs by automation, it has been the usual practice to rely on manual labors in masking and unmasking particular coating areas despite a conspicuous drop in production efficiency.

Further, in the case of the two-tone coating method using masking tapes, it is a paramount requisite to bake and cure the coating films of the color A area into a dried state before adhering masking tapes on the surfaces of the color A or of the clear paint. For this purpose, the coating process should include a step of coating a color paint, a step for coating clear paint and steps of baking coating films separately for each one of the colors A and B, which is obviously disadvantageous in view of degradations in productivity and increases in production cost.

In an attempt to improve the productivity of the two-tone coating process by aborting the masking step or by aborting the use of masking tapes, there have been developed a number of coating methods as disclosed, for example, in Laid-Open Japanese Patent No. S58-58168 and Laid-Open Japanese Patent No. H11-57606.

Firstly, above-mentioned Laid-Open Japanese Patent No. S58-58168 discloses a method for coating heavy anti-rust or corrosion-proof paint, (hereinafter referred to simply as "the first prior art" for brevity), by the use of a coating robot having a sprayer unit and a masking device in the form of a masking plate on a fore distal end portion of a robot arm. According to this coating method, a fore end portion of the masking plate is abutted against a vehicle body at the time of a heavy anti-rust coating operation thereby covering the vehicle body on the upper side of the masking plate. In this state, lower portions of the vehicle body are coated with a heavy corrosion-proof paint which is sprayed from the sprayer unit.

On the other hand, disclosed in above-mentioned Laid-Open Japanese Patent No. H11-57606 (hereinafter referred to simply as "the second prior art" for brevity) is a two-tone coating method employing, for the purpose of demarcating a border line on a work object 101, a sprayer unit which employs a binary fluid nozzle spray gun (or the so-called air brush gun) 102 with straight directionability, namely, with a narrow spray pattern which is smaller than 30 degrees in diverging angle θ as shown in FIG. 36. An air gun (not shown) is located over the spray gun 102 thereby to spurt air toward a border line of a coating area. In addition, according to the coating method of the second prior art, the spray gun 102 is tilted with respect to a work object 101 by an angle which is greater than half the diverging angle θ of the spray pattern (>½θ). Namely, a border line of a coating area is demarcated on the work object 101 by spraying paint from the spray gun 102 in the tilted position. During a coating operation, air is spurted toward the border line from the air gun to prevent deposition, for example, of a color B paint on an adjoining coating area which was coated with a color A paint in a preceding stage.

In the case of the coating method according to the first prior art, that is, in the case of the coating method according to Laid-Open Japanese Patent No. S58-58168, the masking plate is adapted to cover surface areas other than a target coating area. Therefore, a large mount of paint inevitably deposits on the masking plate during a coating operation, necessitating the provision of a paint scraper in association with the masking plate to scrape deposited paint off and as a consequence requiring larger and more complicated equipment. Besides, the fore end of the masking plate which is held in abutting engagement with a vehicle body during a coating operation always has the possibility of damaging or bruising coating surfaces. For this reason, the coating method according to the first prior art may be applicable to undercoatings like heavy anti-corrosive coatings which would not require a quality finish, but does not suit for application to finish coatings.

Further, in the case of the coating method according to the above-mentioned second prior art, disclosed in Laid-Open Japanese Patent No. H11-57606, a binary fluid nozzle spray gun 102 (an air brush gun) is employed as a sprayer unit for demarcating a border line. The spray gun 102 of this sort is adapted to spurt paint under the pressure of jet air. That is, paint is vigorously spurted out from the spray gun 102 together with jet air. Therefore, there is always a problem that, while demarcating a border line by the use of a color B paint, splashes of color B paint particles rebounding on the surfaces of the work object 101 tend to scatter around and deposit on surfaces of the coating film in the adjoining color A area.

Further, according to the coating method of the above-mentioned second prior art, air is spurted toward the position of the border line from an air gun. A problem with an air gun of this sort is that, because of the difficulty of controlling the direction of an air jet precisely toward an aimed position, the spray of paint from the spray gun 102 is often blown off and broken up by air jets, resulting in disturbances of the border line.

Furthermore, generally the binary fluid nozzle spray gun 102 has been used as a brush in artistic work, for example, for spraying a color on a painting, poster or craft work. In addition, the binary fluid nozzle spray gun 102 is suited for spraying a relatively small amount of a low viscosity dye color or a laquer type paint, and low in capacity of atomizing paint which is used for coating vehicle bodies or the like. Namely, the binary fluid nozzle spray gun 102 is suited for drawing a thin line by means of a small spray pattern, but not suited for coating broad surface areas of a vehicle body or the like. Even if used for coating vehicle bodies, it would take a considerably long coating time and fail to yield high quality finish coatings.

DISCLOSURE OF THE INVENTION

In view of the above-discussed problems with the prior art, it is an object of the present invention to provide a method for coating a work object in two tones, which can paint a border line in a clearly defined form to distinguish one coating area from an adjacent coating area of a different color, while permitting a reduction of the number of steps for a two-tone coating operation, improve the reliability of operation, and cut the cost of two-tone coating operations.

According to the present invention, in order to achieve the above-stated objectives, there is provided a method for coating a work object in two tones, comprising: a first color coating stage for coating a first color area on a coating surface of said work object with first color paint; a border zone coating stage for coating a border zone with second color paint, by (1) positioning a rotary atomizing head of a sprayer unit at a distance to said work object that is well within the range of the sprayer and in an inclined state tilted toward said border zone, (2) supplying mist blocking air in a direction forward of said rotary atomizing head to block mist of said second color paint from scattering and flying toward a first color coating on said first color area, (3) without supplying other shaping air to shape a spray pattern, (4) applying no high voltage to paint, and (5) coating a border zone with said second color paint to paint a border line bounding on said first color area; and a belt zone coating stage for coating a belt zone with said second color paint, by (1) positioning a rotary atomizing head of a sprayer unit at a distance to said work object that is well within the range of the sprayer and in an inclined state tilted toward belt zone, (2) supplying mist blocking air in a direction forward of said rotary atomizing head to block mist of said second color paint from scattering and flying toward a first color coating on said first color area, (3) applying no high voltage to paint, and (4) coating said second color paint on said belt zone continuously from said border zone coating on said border zone by putting said rotary atomizing head in a reciprocating pattern.

In the case of the arrangements just described above, in the first color area coating stage, first color paint is applied on a coating surface of a work object to form a first color coating thereon.

In the next border zone coating stage, the rotary atomizing head which is located at a distance to the work object that is well within the range of the sprayer, is tilted toward the border zone on the coating surface, while mist blocking air is supplied forward of the rotary atomizing head to prevent mist, i.e., fine particles of second color paint, from scattering and flying toward the first color coating. In this stage, no other shaping air is supplied to shape the spray pattern. A high voltage is not applied to the paint, and paint is sprayed by high speed rotation of the rotary atomizing head.

Accordingly, the second color paint is pulled toward a negative pressure region which is formed forward of the rotary atomizing head by high speed rotation of the latter, and at the same time urged to fly radially outward under the influence of centrifugal force. In this case, however, since the rotary atomizing head is positioned at a distance from a work object that is well within the range of the sprayer, second color paint is allowed to reach and deposit on the work object before it is atomized and scattered around by pneumatic resistance. Therefore, a clear border line can be painted on the work object. Besides, since the rotary atomizing head is tilted with respect to a coating surface of the work object, second color paint can be sprayed solely by centrifugal force without resorting to jet air, so that paint particles are allowed to deposit and settle on a coating surface without scattering and rebounding off the coating surface. In addition, the mist blocking air which is supplied forward of the rotary atomizing head blocks paint particles from scattering and flying toward the first color coating, ensuring to finish the coating in favorable conditions.

In the next belt zone coating stage, the rotary atomizing head which is located at a distance from the work object that is well within the range of the sprayer, is tilted toward the belt zone on the coating surface, while mist blocking air is supplied in a direction forward of the rotary atomizing head. In this stage, either no voltage is applied or a low voltage is applied if necessary, while coating a wide belt zone (belt-like surface area) on the coating surface of the work object with second color paint continuously from the border line by the rotary atomizing head which is put in a reciprocating pattern.

As a consequence, scattering of paint particles is blocked substantially in the same maimer as in the above-described border zone coating stage as second color paint is coated on the work object continuously under the border zone coating. At this time, since the rotary atomizing head is put in a reciprocating pattern, second color paint can be coated over a wide surface area of the work object continuously from the border zone coating.

According to the present invention, there is also provided a method for coating a work object in two tones, which comprises: a first color coating stage for coating a first color area on a coating surface of said work object with first color paint; a border zone coating stage for coating a border zone with second color paint, by (1) positioning a rotary atomizing head of a sprayer unit at a distance to said work object that is well within the range of the sprayer and in an inclined state tilted toward said border zone, (2) supplying mist blocking air in a direction forward of said rotary atomizing head to block mist of said second color paint from scattering and flying toward a first color coating formed on said first color area, (3) without supplying any other shaping air to shape a spray pattern, (4) applying no high voltage to the paint, and (5) coating a border zone with said second color paint to paint a border line bounding on said first color area; a belt zone coating stage for coating a belt zone with said second color paint, by (1) positioning a rotary atomizing head of a sprayer unit at a distance to said work object that is well within the range of the sprayer and with the sprayer in an inclined state tilted toward said belt zone, (2) supplying mist blocking air in a direction forward of said rotary atomizing head to block mist of said second color paint from scattering and flying toward a first color coating on said first color area, (3) applying no high voltage to the paint, and (4) coating said second color paint on said belt zone continuously from said border zone coating on said border zone by putting said rotary atomizing head in a reciprocating pattern of movements; and a remainder area coating stage for coating said second color paint on remainder areas of said work object left subsequent to said belt zone coating stage.

In this instance, in the first color area coating stage, first color paint is applied on a coating surface of a work object to form a first color coating thereon.

In the next border zone coating stage, the rotary atomizing head, which is located at a distance to the work object that is well within the range of the sprayer, is tilted toward the border zone on the coating surface, while mist blocking air is supplied forward of the rotary atomizing head to prevent mist, i.e., fine particles of second color paint, from scattering and flying toward the first color coating. In this stage, no other shaping air is supplied to shape the spray pattern. A high voltage is not applied to the paint, and paint is sprayed by high speed rotation of the rotary atomizing head.

Accordingly, second color paint is pulled toward a negative pressure region which is formed forward of the rotary atomizing head by high speed rotation of the latter, and at the same time urged to fly radially outward under the influence of centrifugal force. In this case, however, since the rotary atomizing head is positioned at a distance from a work object that is well within the range of the sprayer, second color paint is allowed to reach and deposit on the work object before it is atomized and scattered around by pneumatic resistance. Therefore, a clear border line can be painted on the work object. Besides, since the rotary atomizing head is tilted with respect to a coating surface of the work object, second color paint can be sprayed solely by centrifugal force without resorting to jet air, so that paint particles are allowed to deposit and settle on a coating surface without scattering and rebounding off the coating surface. In addition, the mist blocking air which is supplied forward of the rotary atomizing head blocks paint particles from scattering and flying toward the first color coating, ensuring that the coating will be finished in favorable conditions.

In the next belt zone coating stage, the rotary atomizing head, which is located at a distance from the work object that is well within the range of the sprayer, is tilted toward the belt zone on the coating surface, while mist blocking air is supplied in a direction forward of the rotary atomizing head. In this stage, a high voltage is not applied, while coating a wide belt zone on the coating surface of the work object with second color paint continuously from the border line by the rotary atomizing head which is put in a reciprocating pattern.

As a consequence, scattering of paint particles is suppressed substantially in the same manner as in the above-described border zone coating stage as second color paint is coated on the work object continuously under the border zone coating. Further, a broad belt zone (a belt-like area) is coated by a reciprocating pattern of the rotary atomizing head in the belt zone coating stage, so that, in coating second color paint in the succeeding remainder area coating stage, the rotary atomizing head can be located at a large distance from the first color coating to prevent particles of second color paint from depositing on the first color coating.

In the remainder area coating stage, second color paint is coated on remaining areas of the coating surface continuously from the belt zone coating. At this time, the border zone coating and the belt zone coating of second color paint intervene between the first color coating and the remainder areas to be painted in the remainder area coating stage, so that particles of second color paint can be prevented from scattering and flying toward the first color coating even under normal coating conditions.

According to the present invention, coating is formed on the work object in the border zone coating stage, by (1) reducing a coating distance between a confronting marginal edge of the rotary atomizing head and the work object to a minimal value when the rotary atomizing head is in a coating position for painting the border line bounding on a first color coating on the first color coating area, and (2) increasing the coating distance between the marginal edge of the rotary atomizing head and the work object when the rotary atomizing head is moved in a direction away from the border line, (3) while moving the rotary atomizing head in a reciprocating pattern toward and away from the border line in a direction of intersecting the latter.

In this instance, in relation with the reciprocating coating action, the marginal edge of the rotary atomizing head is positioned closer to a coating surface on the side of a border line bounding on the first color coating, thereby forming the border line with thick and clear coating. On the other hand, when in a position away from the first color coating and the border line, the rotary atomizing head is located at a greater distance from the work object to spray paint particles over a broader area. Accordingly, flat and thinner coating is formed on a surface area distant from the border line.

According to the present invention, the rotary atomizing head is moved substantially parallel with the border line while painting a border zone area in the border zone coating stage.

In this case, by moving the rotary atomizing head parallel with the border line, a smooth (rectilinear) border line can be painted on the surface of the work object.

According to the present invention, coating is applied on a surface area of the work object in the belt zone coating stage, by (1) reducing the coating distance between a confronting marginal edge of the rotary atomizing head and work object to a minimal value on the side of a border zone coating, (2) increasing the coating distance between the marginal edge of the rotary atomizing head and the work object when the rotary atomizing head is moved in a direction away from the border zone coating, (3) while the rotary atomizing head moves in a reciprocating pattern toward and away from the border line in a direction of intersecting the latter.

In this instance, at a position on the side of the border zone coating, the coating distance between an opposing marginal edge of the rotary atomizing head and a coating surface is reduced to a minimum value to prevent particles of second color paint from depositing on the first color coating across the border zone coating. Besides, at the time of forming second color coating continuously under the belt zone coating, flat and thinner coating can be formed in overlapping portions of second color paint, namely, on surface areas away from the border line.

According to the present invention, the rotary atomizing head is moved substantially parallel with the border line while painting the belt zone in the belt zone coating stage.

In this instance, second color paint which is sprayed by the rotary atomizing head is coated on substantially parallel with the border line, and particles of second color paint are prevented from flying toward the first color coating across the border zone coating and the belt zone coating.

According to the present invention, in the belt zone coating stage, in addition to the mist blocking air, shaping air is either not supplied at all or supplied in a suppressed amount which will not disturb the mist blocking air.

In this instance, second color paint which is sprayed from the rotary atomizing head by centrifugal force is allowed to deposit on the work object free of possibilities of disturbance by shaping air, and particles of second color paint are prevented from flying toward and depositing on the first color coating.

According to the present invention, the rotary atomizing head of the sprayer unit is provided with an air nozzle adapted to spurt mist blocking air in a direction forward of the rotary atomizing head, the air nozzle being turned on to supply mist blocking air forward of the rotary atomizing head in the border zone coating stage and the belt zone coating stage.

In this instance, when mist blocking air is supplied in a direction forward of the rotary atomizing head, the mist blocking air prevents particles of second color paint from flying toward and depositing on the first color coating.

According to the present invention, the rotary atomizing head of the sprayer unit is provided with an air nozzle adapted to spurt mist blocking air in a forward direction toward the rotary atomizing head and a flow rectification plate for guiding mist blocking air from the air nozzle in a direction forward of the rotary atomizing head, the air nozzle being turned on to spurt out mist blocking air and supply same forward of the rotary atomizing head under the guidance of the flow rectification plate in the border zone coating stage and the belt zone coating stage.

In this instance, the mist blocking air which is supplied from the air nozzle toward the rotary atomizing head is hit on the flow rectification plate and thereby turned toward the rotary atomizing head. By the mist blocking air which is controlled by the flow rectification plate, particles of second color paint are prevented from flying toward the first color coating across the border line in a reliable manner.

According to the present invention, in the border zone coating stage and the belt zone coating stage, the rotary atomizing head is tilted through an angle in the range between 50 degrees and 80 degrees with respect to a straight line normal to the coating surface of the work object.

In this instance, paint particles which are sprayed by the rotary atomizing head under the influence of centrifugal force are allowed to deposit and settle on a coating surface of the work object without scattering in the direction of the first color coating.

According to the present invention, there is also provided a method for coating a work object in two tones, which comprises: a first color coating stage for coating a first color area on a coating surface of said work object with first color paint; a bordering belt zone coating stage for coating a bordering belt zone with second color paint, by (1) positioning a rotary atomizing head of a sprayer unit at a distance to said work object that is well within the range of the sprayer and in an inclined state tilted toward said bordering belt zone, (2) supplying mist blocking air in a direction forward of said rotary atomizing head to block mist of said second color paint from scattering and flying toward a first color coating on said first color area, (3) without supplying any additional shaping air to shape a spray pattern, (4) applying no high voltage to paint, and (5) coating said bordering belt zone with said second color paint to paint a border line bounding on said first color area by putting said rotary atomizing head in a reciprocating pattern of movements; and a remainder area coating stage for coating said second color paint on remainder area of said work object subsequent to said bordering belt zone coating stage.

In this instance, in the first color area coating stage, first color paint is applied on a coating surface of a work object to form a first color coating thereon.

In the next bordering belt zone coating stage, the rotary atomizing head, which is located at a distance from the work object that is well within the range of the sprayer, is tilted toward a bordering belt zone on the coating surface, while mist blocking air is supplied forward of the rotary atomizing head to prevent mist, i.e., fine particles of second color paint, from scattering and flying toward the first color coating. In this stage, no other shaping air is supplied to shape the spray pattern. A high voltage is not applied to the paint, and paint is sprayed by high speed rotation of the rotary atomizing head.

Accordingly, the second color paint is pulled toward a negative pressure re is formed forward of the rotary atomizing head by high speed rotation of the latter, and at the same time urged to fly radially outward under the influence of centrifugal force. In this case, however, since the rotary atomizing head is positioned at a distance from a work object that is well within the range of the sprayer, second color paint is allowed to reach and deposit on the work object before it is atomized and scattered around by pneumatic resistance. Therefore, a clear border line can be painted on the work object. Besides, since the rotary atomizing head is tilted with respect to a coating surface of the work object, second color paint can be sprayed solely by centrifugal force without resorting to jet air, so that paint particles are allowed to deposit and settle on a coating surface without scattering and rebounding off the coating surface. In addition, the mist blocking air which is supplied forward of the rotary atomizing head blocks paint particles from scattering and flying toward the first color coating, ensuring that the coating will be finished in favorable conditions.

In the remainder area coating stage, remainder areas of the coating surface on the work object are coated with second color paint continuously from the bordering belt zone. At this time, the broad bordering belt zone coating of second color paint intervenes between the first color coating and the remainder surface areas to be painted in the remainder area coating stage, so that particles of second color paint can be prevented from scattering and flying toward the first color coating even under normal coating conditions.

According to the present invention, a coating is applied in the bordering belt zone coating stage, by (1) reducing the coating distance between the confronting marginal edge of the rotary atomizing head and the work object to a minimal value when the rotary atomizing head is in a coating position for painting the border line bounding on a first color coating on the first color coating area, and (2) increasing the coating distance between the marginal edge of the rotary atomizing head and the work object when the rotary atomizing head is moved in a direction away from the border line, (3) while moving the rotary atomizing head in a reciprocating pattern toward and away from the border line in a direction of intersecting the latter.

In this instance, in relation with the reciprocating coating action, the marginal edge of the rotary atomizing head is positioned closer to a coating surface on the side of a border line bounding on the first color coating, thereby forming the border line with thick and clear coating. on the other hand, when in a position away from the first color coating and the border line, the rotary atomizing head is located at a greater distance from the work object to spray paint particles over a broader area. Accordingly, flat and thinner coating is formed on a surface area distant from the border line.

According to the present invention, the rotary atomizing head is moved substantially parallel with the border line while painting a border zone area in the bordering belt zone coating stage.

In this instance, by moving the rotary atomizing head parallel with the border line, a smooth (rectilinear) border line can be painted on the surface of the work object.

According to the present invention, the rotary atomizing head of the sprayer unit is provided with an air nozzle adapted to spurt mist blocking air in a direction forward of the rotary atomizing head, the air nozzle being turned on to supply mist blocking air forward of the rotary atomizing head in the bordering belt zone coating stage.

According to the present invention, the rotary atomizing head of the sprayer unit is provided with an air nozzle adapted to spurt mist blocking air in a forward direction toward the rotary atomizing head and a flow rectification plate for guiding mist blocking air from the air nozzle in a direction forward of the rotary atomizing head, the air nozzle being turned on to spurt out mist blocking air and supply same forward of the rotary atomizing head under the guidance of the flow rectification plate in the bordering belt zone coating stage.

According to the present invention, in the bordering belt zone coating stage, the rotary atomizing head is tilted through an angle in the range between 50 degrees and 80 degrees with respect to a straight line normal to the coating surface of the work object.

In this instance, paint particles which are sprayed by the rotary atomizing head under the influence of centrifugal force are allowed to deposit and settle on a coating surface of the work object without scattering in the direction of the first color coating.

According to the present invention, the coating method further comprises a baking stage for baking coatings of the first and second color paint simultaneously after completing coating operations of the respective coating stages.

In this instance, after coating first color paint, second color paint is coated on before baking and curing first color coating into a dried state, namely, when first color coating is still in a wet state, by the so-called wet-on-wet process. Therefore, it becomes possible to omit a baking stage subsequent to a first color area coating stage, which is inevitably required in the above-described prior art for masking purposes thereby simplifying the coating process.

BRIEF DESCRIPTION OF THE DRAWINGS

In the accompanying drawings:

FIG. 15 is a table showing coating conditions for the respective coating areas and zones;

BEST MODE FOR CARRYING OUT THE INVENTION

Figure 1:
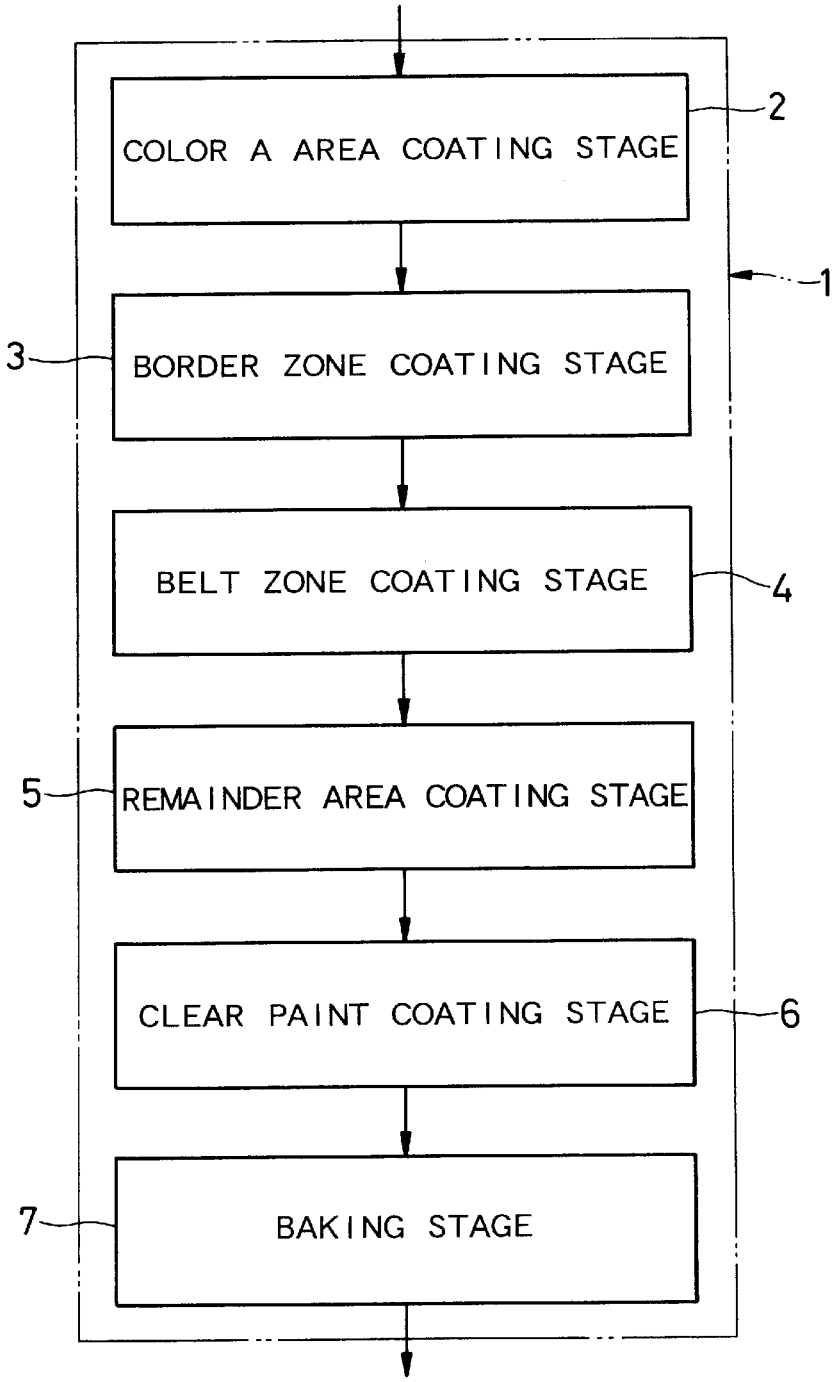
FIG. 1 is a block diagram of a two-tone coating process executed on a coating plant line in a first embodiment of the two-tone coating method according to the present invention.

Hereafter, the two-tone coating method according to the present invention is described more particularly by its preferred embodiments which are applied by way of example to two-tone coating of a vehicle body, a typical work object to which the present invention is applicable.

Referring first to FIGS. 1 through 23, there is shown a first embodiment of the two-tone coating method according to the present invention, using sprayer units and coating equipment as described below.

Indicated at 1 is a coating plant with a coating line which is arranged to coat a vehicle body 12 in two colors (in two tones), i.e., with a first color or color A paint and a second color or color B paint. More specifically, a conveyer 11 is provided in the coating plant 1 to transfer a vehicle body through a color A area coating stage 2, a border zone coating stage 3, a belt zone coating stage 4, a remainder area coating stage 5, a clear paint coating stage 6 and a baking stage 7, which are provided along the coating line from the upstream to downstream side of the conveyer 11.

In the initial color A area coating stage 2, the color A paint is coated on an upper half of the vehicle body 12, including the entire exterior surfaces of the bonnet 12A and roof 12B and upper half portions of left front door 12C, left rear door 12D, right front door, right rear door (both not shown in the drawings), and a back door 12E.

Figure 17:
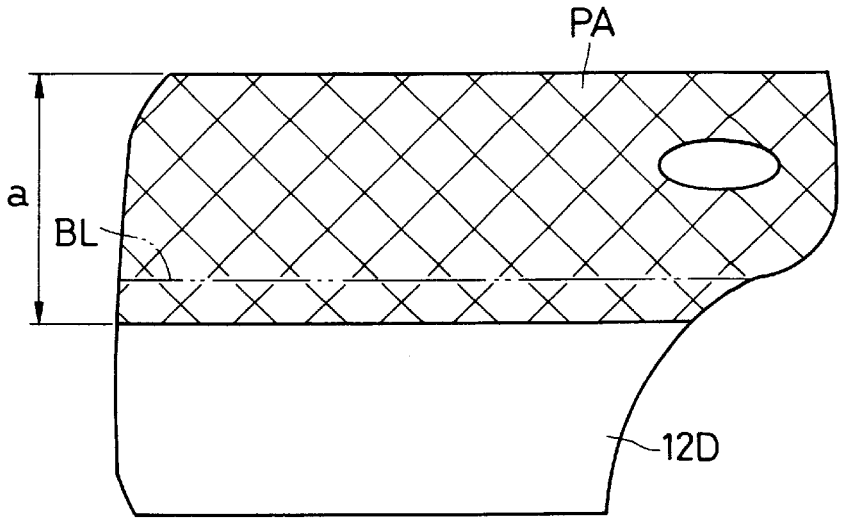
FIG. 17 is a schematic illustration showing a color A coating area on a vehicle door, which has been painted in color A in the color A area coating stage.
Figure 18:
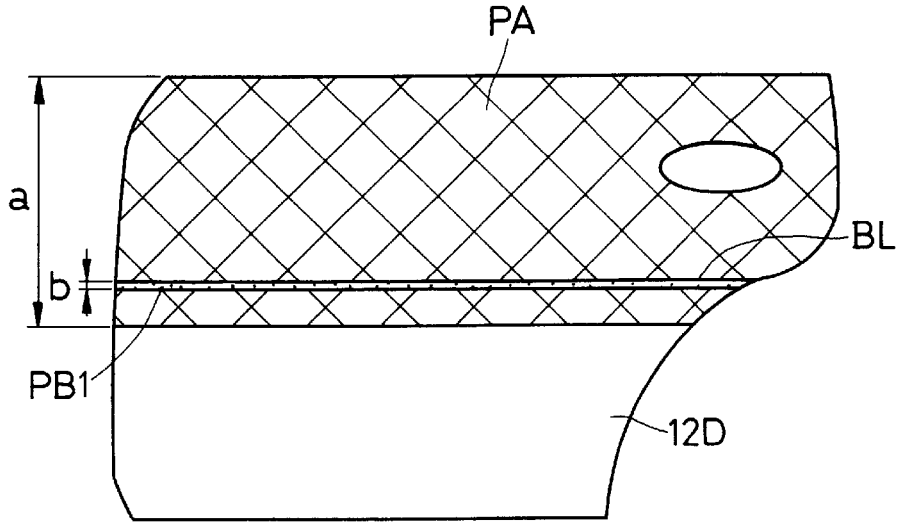
FIG. 18 is a schematic illustration showing a border zone on the vehicle door, which has been painted in a border zone coating stage.
Figure 22:
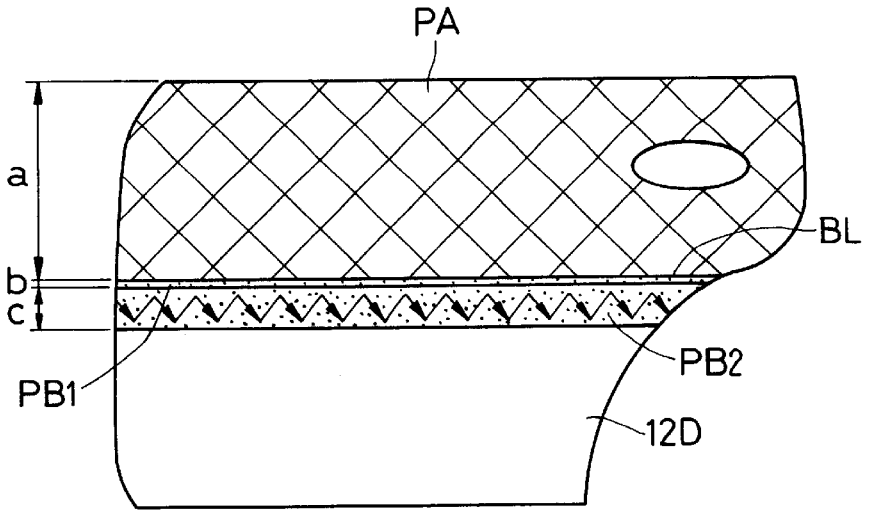
FIG. 22 is a schematic illustration showing a belt zone which is formed and painted in a belt zone coating stage.
Figure 23:
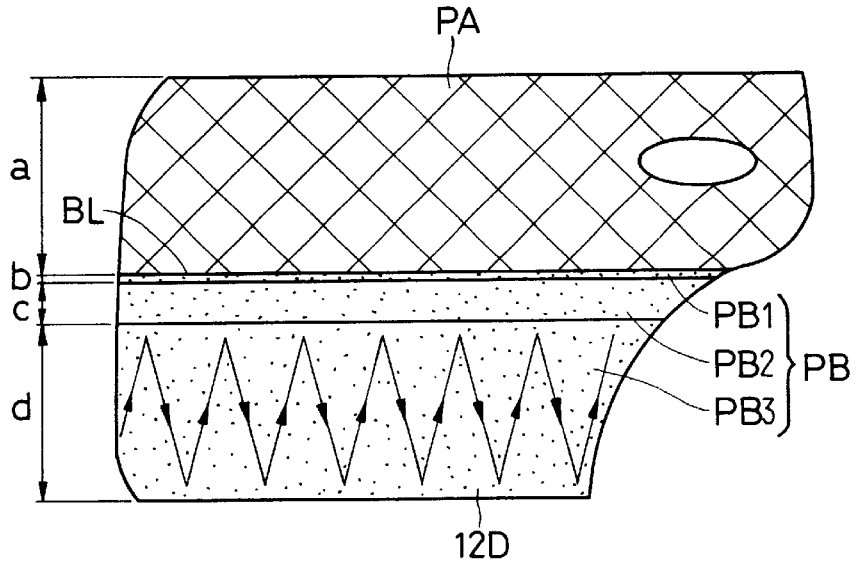
FIG. 23 is a schematic illustration of a remainder area coating which is formed on a vehicle door in a remainder area coating stage.

Here, the two-tone coating method of the present embodiment is explained by way of the left rear door 12D shown in FIG. 17. Namely, in the initial color A area coating stage 2, a color A area a of the vehicle door 12D is coated with the color A paint. In the next border zone coating stage 3, as shown in FIG. 18, a border line BL is painted on a border zone b horizontally across the door by coating the color B paint which is different in color or shade from the color A paint, in overlapping relation with lower portions of the color A coating PA which was painted in the preceding color A area coating stage 2. In the succeeding belt zone coating stage 4, as shown in FIG. 22, a relatively wide coating (a belt-like coating) is formed on a belt zone c by the use of the color B paint, continuously on the lower side of the border zone coating PB1 on the vehicle body 12. In the next remainder area coating stage 5, as shown in FIG. 23, the color B paint is coated on remainder portions of the surfaces of the vehicle body 12 which were not coated in the preceding color A area coating stage 2, border zone coating stage 3 or belt zone coating stage 4. Namely, in the remainder area coating stage 5, the color B paint is coated on remainder areas don the lower side of a belt zone coating PB2 on the belt zone c to form a remainder area coating PB3.

In the next clear paint coating stage 6, a clear paint is coated on the coating films which were formed in the preceding color A area coating stage 2, border zone coating stage 3, belt zone coating stage 4 and remainder area coating stage 5. Then, in the final baking stage 7, the vehicle body 12 is put in a baking furnace (not shown) to cure and set simultaneously all of coating films of the color A paint, color B paint and clear paint which were applied in the preceding coating stages.

Figure 2:
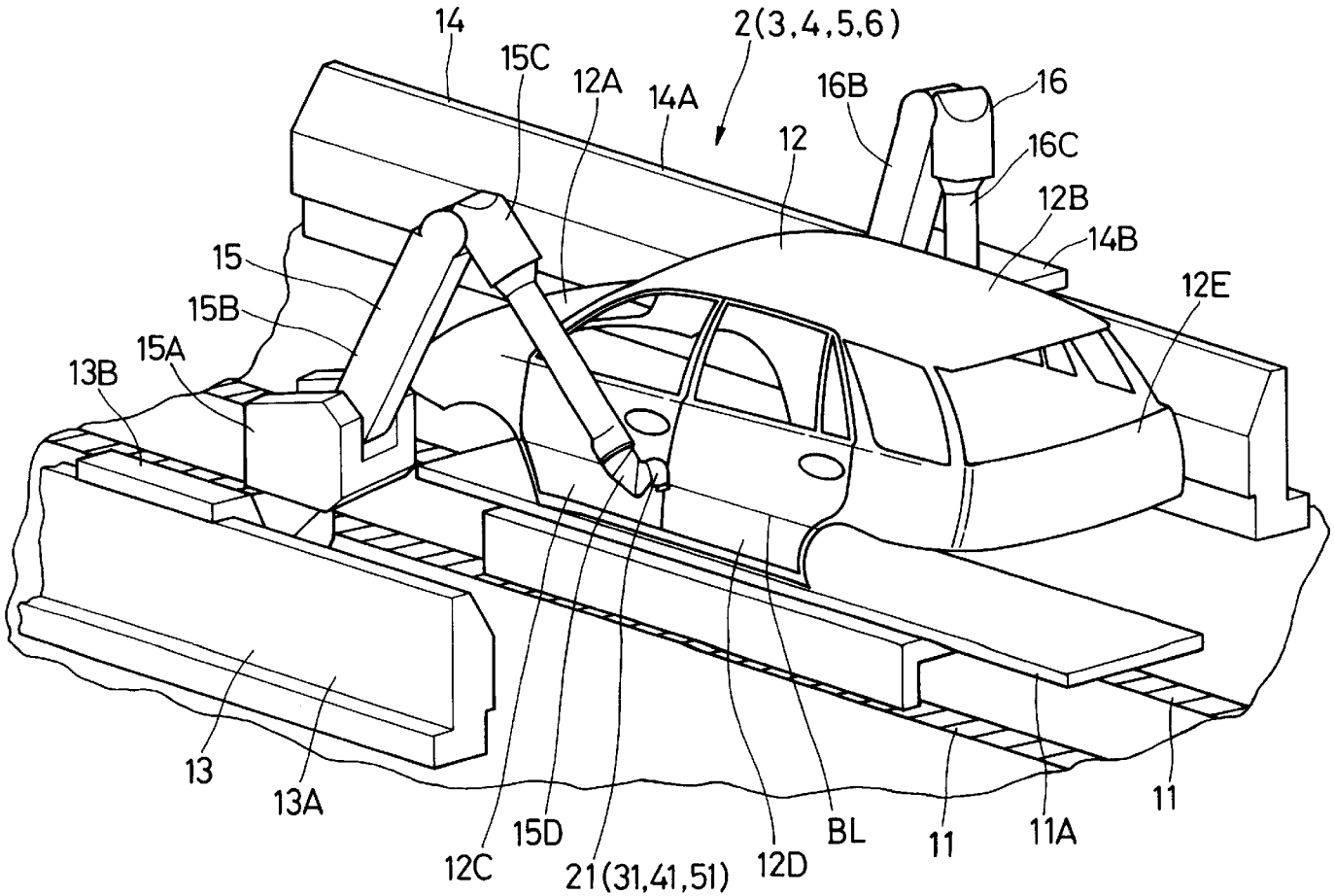
FIG. 2 is a schematic perspective view of a two-tone coating apparatus adopted in the first embodiment of the invention.

In this instance, as shown in FIG. 2, tracking apparatus 13 and 14, coating robots 15 and 16 and rotary atomizing head type sprayer units 21, 31, 41 or 51 are provided in the color A area coating stage 2, border zone coating stage 3, belt zone coating stage 4, remainder area coating stage 6 and clear paint coating stage 6, as will be described in greater detail hereinafter.

Figure 3:
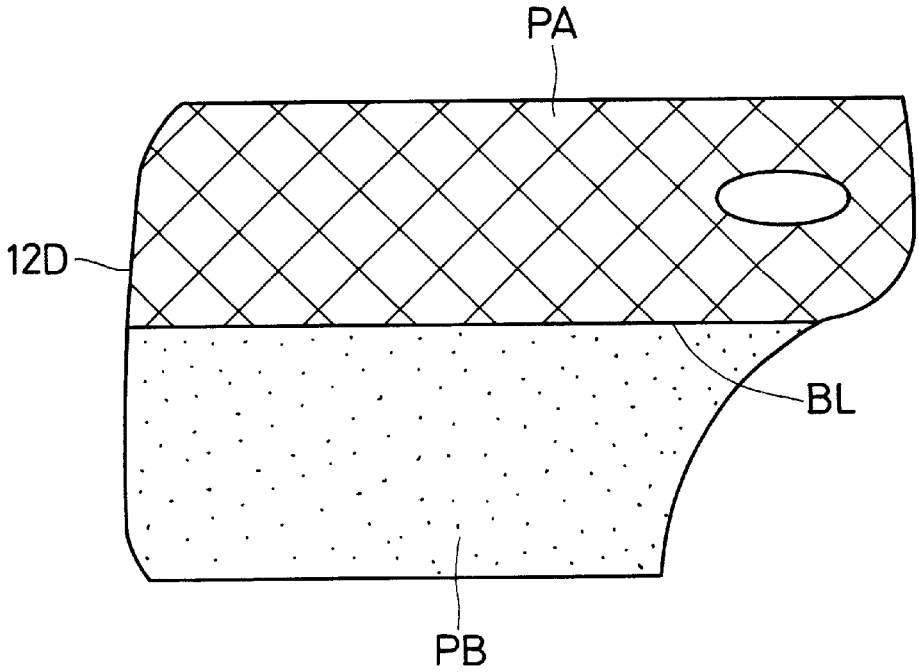
FIG. 3 is a schematic outer view of a left rear door which has been coated in two tones by the method of the invention.

As a vehicle body 12 is passed successively through the respective stages 2 to 5, it is painted in two tones in the same manner as exemplified by way of the left rear door 12D shown in FIG. 3, having a color A coating PA and a color B coating PB in its upper and lower half portions on the opposite sides of a border line BL, respectively.

On the other hand, indicated at 11 are a pair of work transfer conveyers (FIG. 2) which are provided in the coating plant. These conveyers 11 are arranged to run through the color A area coating stage 2, border zone coating stage 3, belt zone coating stage 4, remainder area coating stage 5 and clear paint coating stage 6. Further, a support table 11A is provided on the conveyers 11 to support thereon a vehicle body 12 and transfer same continuously or intermittently forward within the coating plant 1, as described below.

Indicated at 12 is the vehicle body which is mounted on the support table 11A as a work object to be coated. The vehicle body 12 is largely constituted by a bonnet 12A, roof 12B, left front door 12C, left rear door 12D, right front door, right rear door (both of the doors on the right side are not shown in the drawings), and a back door 12E.

Indicated at 13 is a tracking apparatus which is located in the color A area coating stage 2 on the left side of the path of transfer of the conveyers 11. Indicated at 14 is a tracking apparatus which is also located in the color A area coating stage 2 on the right side of the path of transfer of the conveyers 11. In this instance, the tracking apparatus 13 and 14 are largely constituted by tracking rails 13A and 14A which are extended in parallel relation with the conveyers 11, and carriages 13B and 14B which are movable on and along the tracking rails 13A and 14A, respectively. Mounted on the carriages 13B and 14B are coating robots 15 and 16 which will be described below. By the tracking apparatus 13 and 14, coating robots 15 and 16 are movable in the forward or reverse direction in step with the vehicle body 12 which is transferred by the conveyers 11.

Indicated at 15 is the coating robot which is mounted on the carriage 13B of the tracking apparatus 13 on the left side. This coating robot 15 is largely constituted by a rotary base 15A which is rotatably supported on the carriage 13B, a vertical arm 15B which is pivotally supported on the rotary base 15A, and a horizontal arm 15C which is pivotally connected to an upper end portion of the vertical arm 15B, and a wrist 15D is attached to the fore distal end of the horizontal arm 15C.

Further, indicated at 16 is the coating robot which is mounted on the carriage 14B of the tracking apparatus 14 on the right side. Similarly to the above-described coating robot 15, this coating robot 16 is largely constituted by a rotary base (not shown), a vertical arm 16B, a horizontal arm 16C and a wrist (not shown).

Though not shown in the drawings, similar tracking apparatus and coating robots (not shown) are also provided in each one of the above-mentioned border zone coating stage 3, belt zone coating stage 4, remainder area coating stage 5 and clear paint coating stage 6.

Furthermore, in the coating stages 2 to 6 which require applying paint under different conditions, a plural number of rotary atomizing head type sprayer units 21, 31, 41 and 51 are selectively used. These sprayer units 21, 31, 41 and 51 are arranged differently depending upon required coating conditions. For example, in angle of inclination with respect to a coating surface of the vehicle body 12, coating distance between the vehicle body 12 and an opposing marginal edge 23A, 33A, 43A or 53A of the rotary atomizing head 23, 33, 43 or 53, presence or absence of shaping air, presence or absence of mist blocking air, and conditions of high voltage application (whether or not a high voltage is applied or what level of voltage is to be applied).

Figure 4:
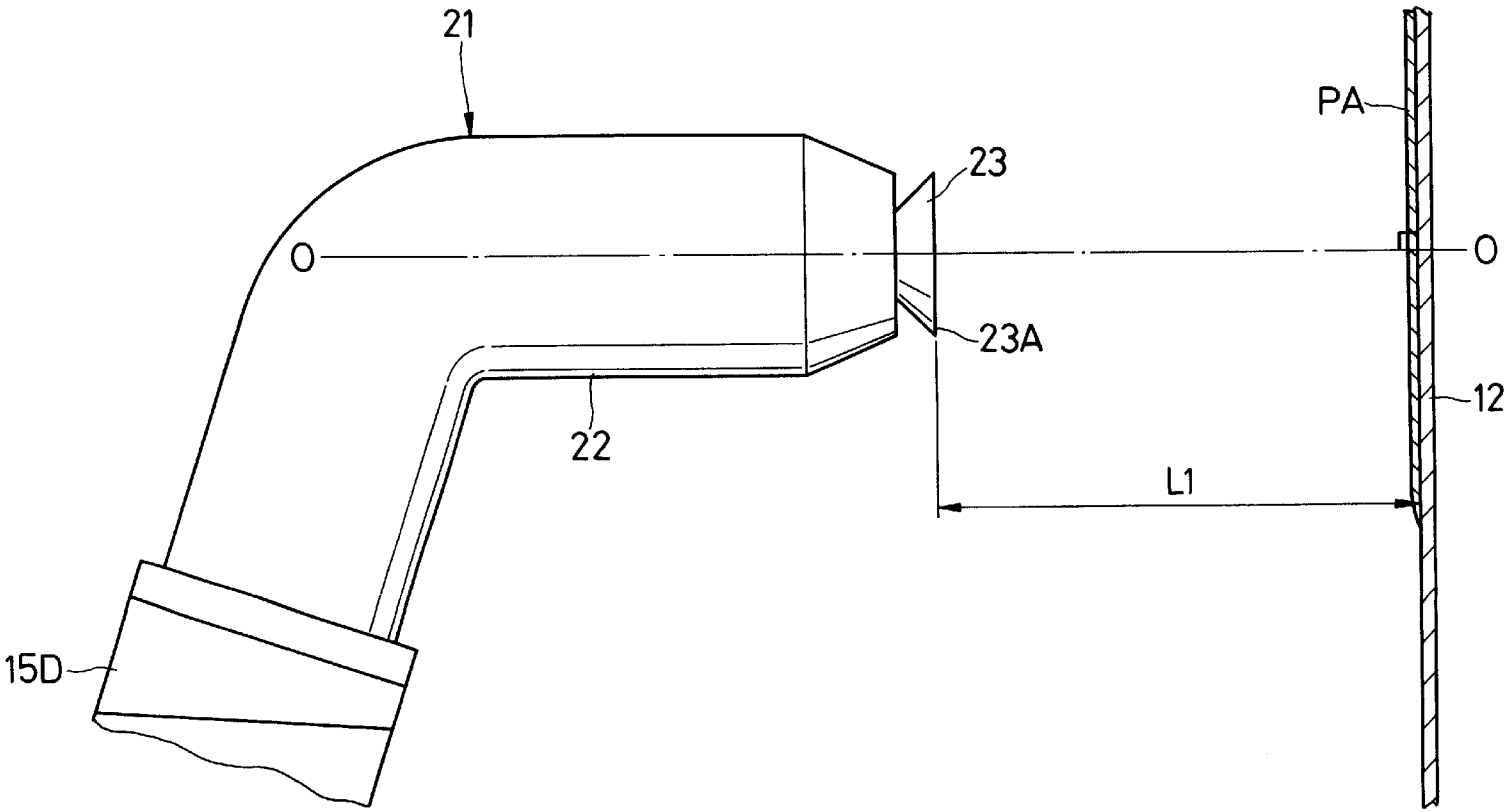
FIG. 4 is an enlarged schematic outer view of a part of a vehicle body and a rotary atomizing head type sprayer unit, which is in a stage of coating a color A area.

In this regard, the rotary atomizing head type sprayer unit 21 which is used in the color A area coating stage 2 is arranged as follows. As shown in FIG. 4, the sprayer unit 21 is constituted by an assembly of a cylindrical casing 22 which is attached to the wrist 15D of the coating robot 15 at its base end and bent angularly in its intermediate portion, and a rotary atomizing head 23 which is provided rotatably at the fore end of the casing 22. The rotary atomizing head 23 is mounted on a rotational shaft of an air motor (not shown) which is built into the casing 22, and thereby put in high speed rotation. Further, extended internally through the casing 22 is a feed tube (not shown) which has its base end connected to a paint supply source and a fore end opened toward the rotary atomizing head 23 to supply paint thereto.

Furthermore, provided at the fore end of the casing 22 and around the rotary atomizing head 23 are a multitude of shaping air outlet holes (not shown) to spurt out shaping air therethrough for shaping the spray pattern. Through the feed tube, the sprayer unit 21 can apply a high voltage to paint to be supplied to the rotary atomizing head, for example, a high voltage in the range of −30 to −120 kv to deposit paint efficiently on the vehicle body 12 which is connected to earth.

In this instance, the rotary atomizing head type sprayer unit 21 which is used in the color A area coating stage 2 is positioned in such a way that the rotational center axis O—O of the rotary atomizing head 23 is disposed substantially at right angles (at an inclination angle $\alpha 1$ of 0 degree) with respect to a coating surface of the vehicle body 12. While the rotary atomizing head type sprayer unit 21 in that position is moved correspondingly to the surface contour of the vehicle body 12, the color A paint coating PA is formed on the vehicle body 12. At this time, as shown in FIGS. 4 and 15, the distance L1 between the coating surface of the vehicle body 12 and an opposing marginal edge 23A of the rotary atomizing head 23 is maintained in the range of 200 mm to 350 mm, and the paint is applied with a high voltage of from −30 kv to −120 kv. Further, for shaping the spray pattern, shaping air is spurted out through the shaping air outlet holes toward paint particles which are sprayed by the rotary atomizing head 23. In this case, an air nozzle and a flow rectification plate which supply mist blocking air in a direction forward of the rotary atomizing head 23 are not provided on the rotary atomizing head type sprayer unit 21 which is used in the color A area coating stage 2.

Figure 5:
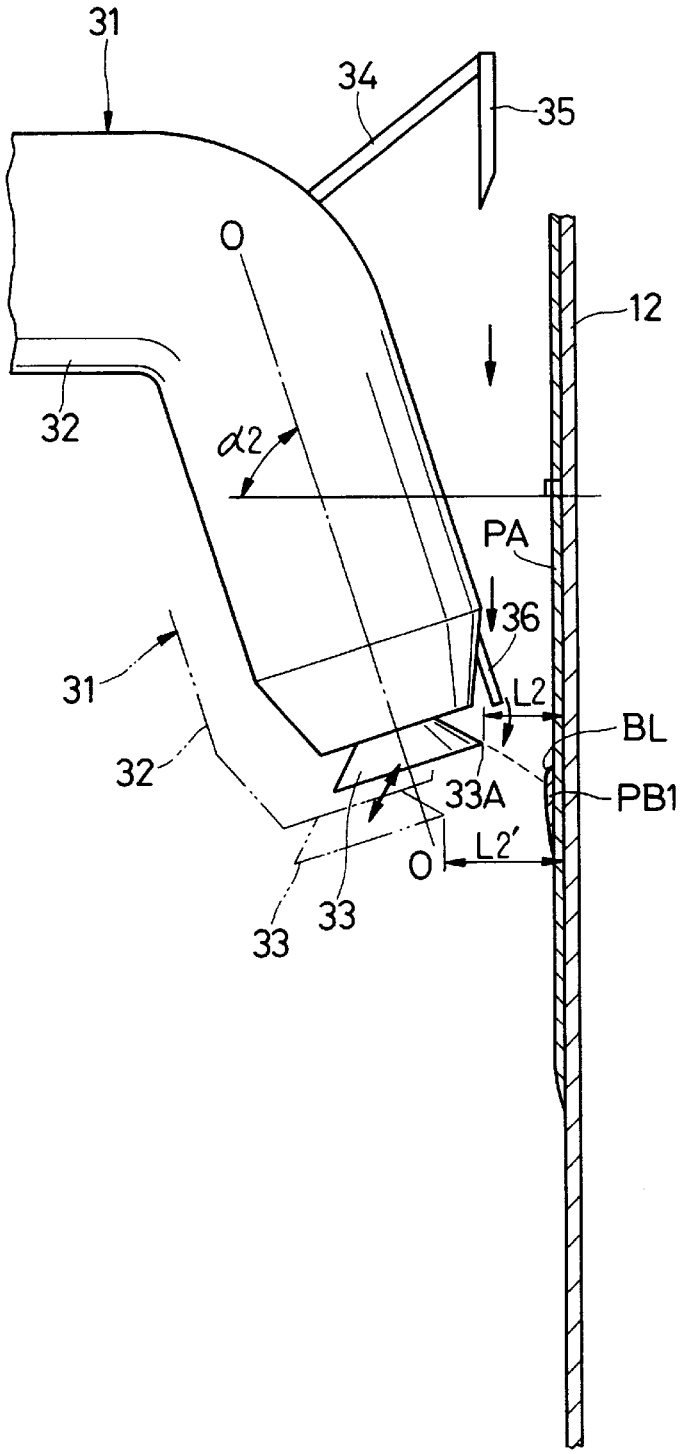
FIG. 5 is an enlarged schematic outer view of a part of the vehicle body and the rotary atomizing head type sprayer unit, which is in a border zone coating stage.

Turning now to FIG. 5, there is shown the rotary atomizing head type sprayer unit 31 which is located on the downstream side of the color A area coating stage 2 for use in the next border zone coating stage 3. Similarly to the sprayer unit 21 for the color A area coating stage 2, the sprayer unit 31 is constituted by an assembly of a cylindrical casing 32 which is bent into an angular form, and a rotary atomizing head 33 which is provided at the fore end of the casing 32. Further, the sprayer unit 31 is provided with an air motor and a feed tube, which are not shown in the drawings, and can apply a high voltage to the paint.

Figure 6:
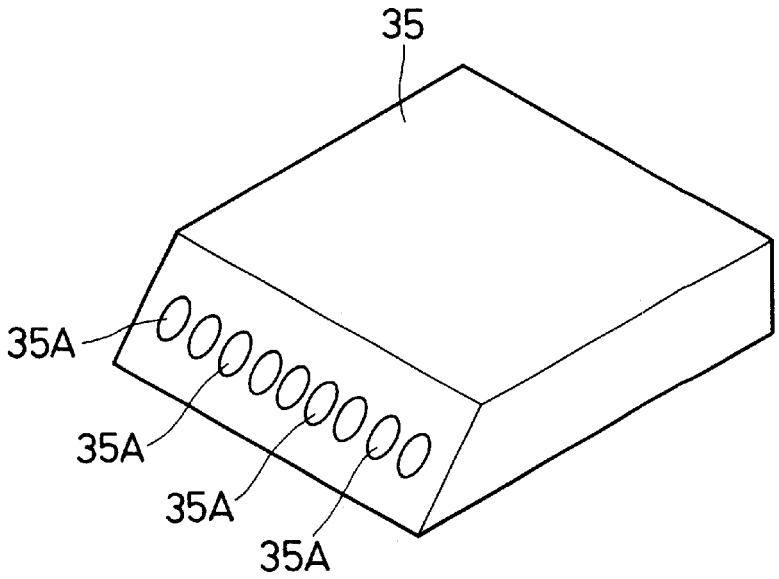
FIG. 6 is an enlarged perspective view of an air nozzle.
Figure 7:
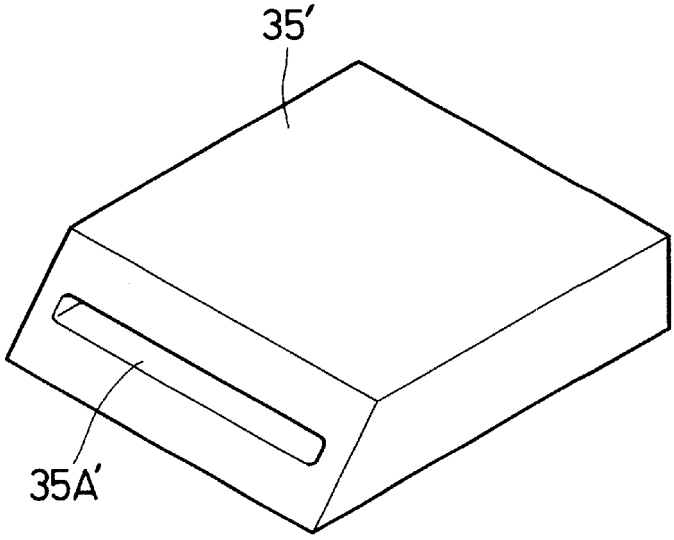
FIG. 7 is an enlarged perspective view of another air nozzle.

However, the sprayer unit 31 for use in the border zone coating stage 3 differs from the sprayer unit 21 in the color A area coating stage 2 in that an air nozzle 35 is provided at a distal end portion of a stay 34, which is extended out from the casing 32, along with a rectification plate 36 which is provided on a fore end portion of the casing 32 and forward of the air nozzle 35. As shown in FIG. 6, the air nozzle 35 is provided with a plural number of air outlet holes 35A which are arranged in a row and opened toward the fore end of the sprayer unit 31. In this connection, there may be employed an air nozzle 35' which is provided with an air outlet hole 35A' as exemplified in FIG. 7. By mist blocking air which is spurted forward from the air outlet holes 35A of the air nozzle 35, particles of the color B paint which is sprayed from the rotary atomizing head 33 are prevented from flying or scattering toward and depositing on the color A coating PA which was applied in the preceding color A area coating stage 2.

Further, by the flow rectification plate 36 which is provided on a fore end portion of the casing 22 as mentioned above, mist blocking air which is supplied from the air nozzle 35 is guided to flow along a coating surface and directed toward the center of the sprayer unit 31, namely, toward the rotary atomizing head 33. Therefore, mist (minute particles) of the color B paint is effectively prevented from flying and scattering in the direction of the color A coating PA.

In the case of the rotary atomizing head type sprayer unit 31 which is used in the border zone coating stage 3, the rotational center axis O—O of the rotary atomizing head 33 is tilted downward (toward the border zone b) with respect to a straight line which perpendicularly intersects the coating surface of the vehicle body, by a predetermined inclination angle $\alpha 2$ in the range between 50 degrees and 80 degrees, for example, by approximately 70 degrees. In this instance, as shown in FIGS. 5 and 15, the distance L2 between the coating surface of the vehicle body 12 and the opposing marginal edge 33A of the rotary atomizing head 33 is set at a value in the range of 5 mm to 20 mm, for example, set at approximately 10 mm when in a position for coating the border line BL. When in a position on the lower side of the border line BL as indicated by a two-dot chain line, the rotary atomizing head 33 is located at a greater distance L2' which is greater than L2. Further, mist blocking air is supplied in a direction forward of the rotary atomizing head 33 by the air nozzle 35. In this border zone coating stage 3, no other shaping air is used, and no high voltage or a voltage approximately as low as −10 kv is applied if necessary.

Advantages accruing from the downward inclination of the rotary atomizing head 33 toward the border zone b and from the location of the rotary atomizing head 33 in the proximity of a vehicle body are explained below with reference to FIGS. 8 to 11.

Figure 8:
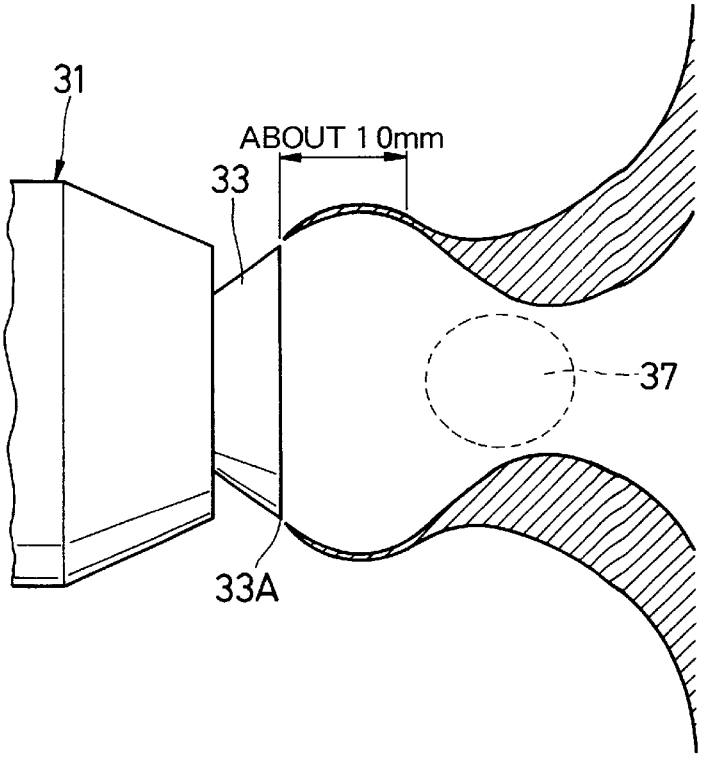
FIG. 8 is a schematic illustration, showing conditions of paint which is sprayed from the rotary atomizing head type sprayer unit.

Firstly, as the rotary atomizing head 33 is put in high speed rotation, it gives rise to strong air streams around and in radial directions of the rotary atomizing head 33. As a result, a negative pressure region 37 is formed forward of the rotary atomizing head 33. Therefore, as shown in FIG. 8, paint particles which are released from the marginal edge 33A of the rotary atomizing head 33 tend to fly in radially outward directions under the influence of centrifugal force resulting from high speed rotation of the rotary atomizing head 33. However, released paint particles are pulled toward the negative pressure region 37, and, after being turned in a converging direction at a position approximately at a distance of 10 mm from the marginal edge 33A of the rotary atomizing head 33, are caused to spread and fly in radially outward directions under the influence of centrifugal force, pneumatic resistance, etc.

Figure 9:
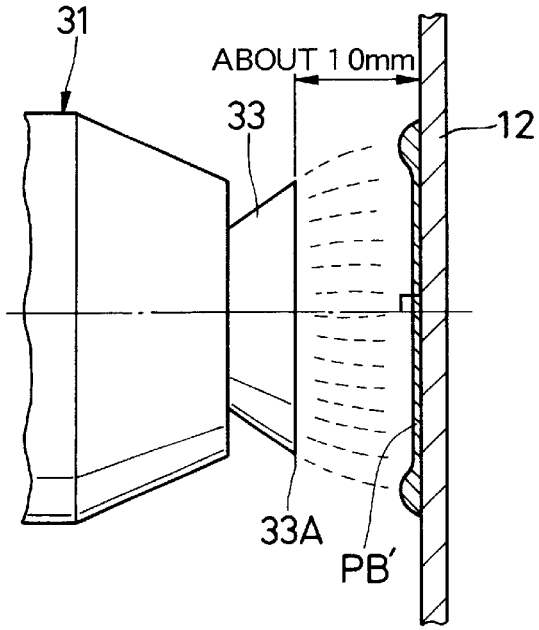
FIG. 9 is a schematic outer view of a sprayer unit which is positioned substantially at right angles with respect to a coating surface of the vehicle body.
Figure 10:
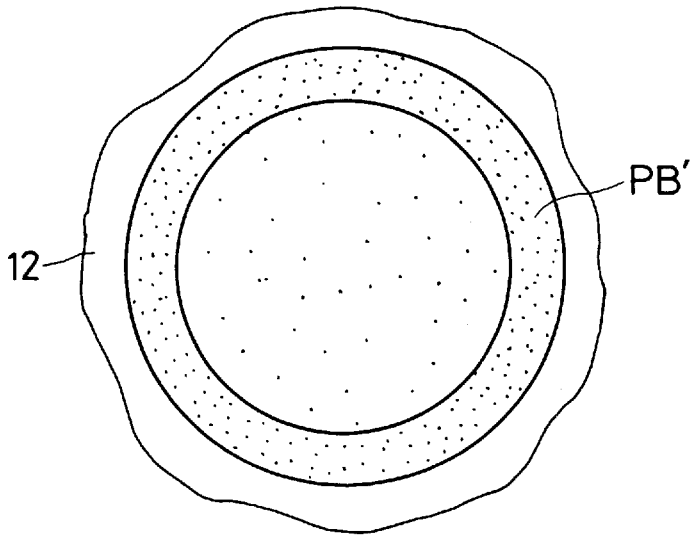
FIG. 10 is a schematic outer view of a pattern of coating by a sprayer unit adopted as a comparative example.
Figure 11:
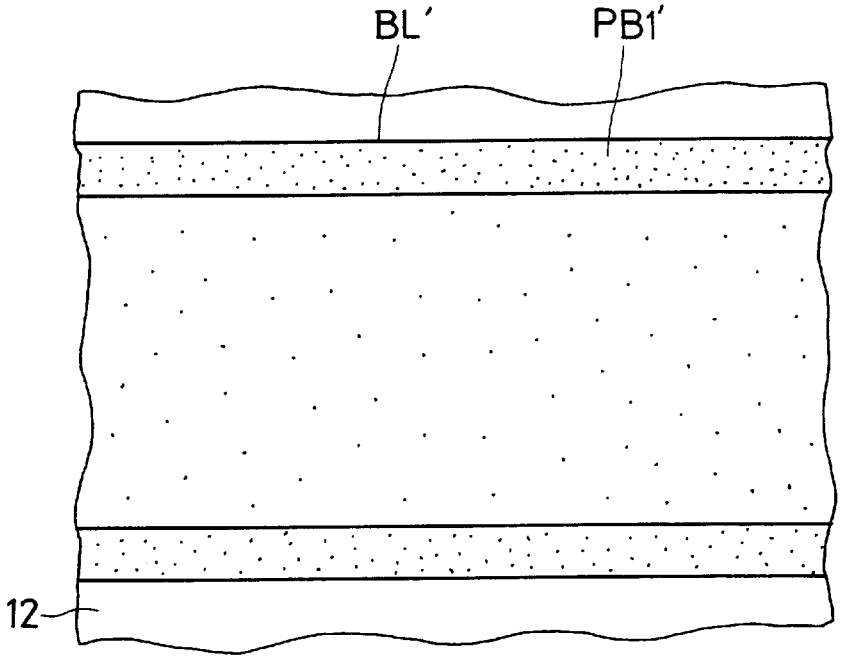
FIG. 11 is a schematic outer view of a border line which has been formed in coating a border zone by the sprayer unit of the comparative example.

Therefore, in a case where the color B paint is sprayed from the rotary atomizing head 33 which is positioned substantially at right angles with respect to a coating surface of the vehicle body 12 and from the marginal edge 33A of the rotary atomizing head 33 which is positioned at a close distance of about 10 mm from the vehicle body 12 as shown in FIG. 9, the color B paint deposits on the vehicle body 12 in a conspicuously hollow pattern, forming a thicker ring-like coating PB' on the outer side as shown in FIGS. 9 and 10. Therefore, if the sprayer unit 31 is moved relative to the vehicle body 12 in this state, a border zone coating BL1' is painted on the vehicle body 12 with the color B paint, which has a conspicuously greater thickness at upper and lower sides of the border zone coating PB1' as shown in FIG. 11. This means that it becomes difficult to form a coating of satisfactory quality finish, which is uniform in coating film thickness distribution, in a succeeding coating stage or stages continuously from the border zone coating BL1'.

Figure 12:
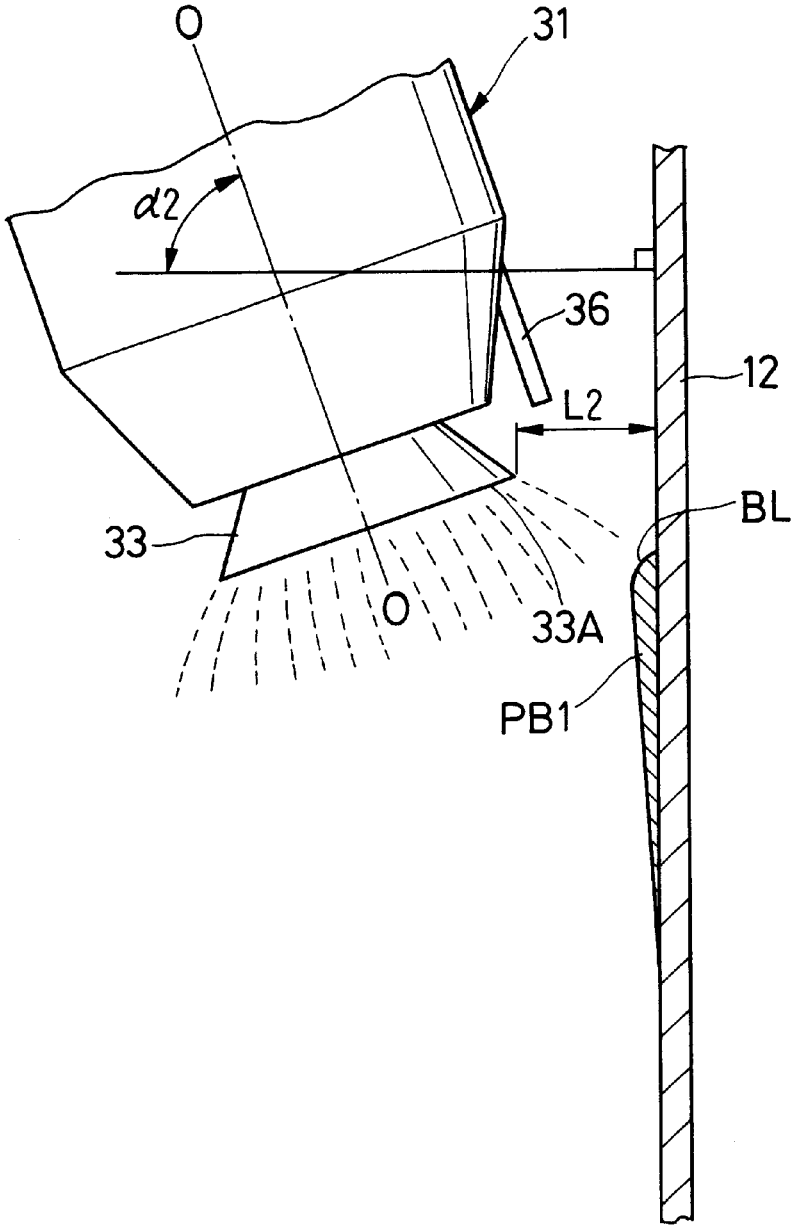
FIG. 12 is a schematic outer view of the rotary atomizing head type sprayer unit which is spraying paint from a fixed position in a border zone coating stage of the vehicle body.

In contrast, according to the present embodiment of the invention, as shown in FIG. 12, the sprayer unit 31 is tilted downward by 70 degrees (with an inclination angle $\alpha 2$=70 degrees), and the marginal edge 33A of the rotary atomizing head 33 is located at a close distance of about 10 mm from the coating surface of the vehicle body 12 (with a coating distance L2=10 mm). In this case, paint particles which are released from the marginal edge 33A of the rotary atomizing head 33 at a closer distance to the vehicle body 12 are mostly allowed to deposit on the vehicle body 12, defining a clear border line BL by way of a border zone coating PB1 which has a sufficient thickness particularly at the position of the border line BL. On the other hand, when in a position away from the border line BL of the border zone coating PB1, the rotary atomizing head 33 is located at a coating distance L2' which is greater than the above-mentioned coating distance L2, and therefore at this position paint particles are sprayed over broader areas to form a thinner gradational coating film which gradually fades out (in a hazy or foggy shade) in its lower end portions. It follows that, when a belt zone coating PB2 is formed continuously on a surface area on the lower side of and in partly overlapping relation with the border zone coating PB1, in a direction away from the border line BL, the above arrangements make it possible to form a coating film of thickness, preventing conspicuous increases in thickness particularly in those areas where the belt zone coating PB2 is overlapped on lower portions of the border zone coating PB1.

Further, the color B paint can be sprayed on a coating surface of the vehicle body 12 solely under the influence of centrifugal force of the rotary atomizing head 33 by setting the coating distance L2 between the marginal edge 33A of the rotary atomizing head 33 and the vehicle body 12 at a value of 10 mm where paint particles are still in the form of a converged flux with less scattering. Unlike paint particles which are spurted out by the use of high pressure air jets, particles of the color B paint which are sprayed by the rotary atomizing head 33, without using air jets, can deposit straight on the surface of the vehicle body 12 and settle thereon to paint a clear border line BL, without rebounding on the coating surface to scatter in random directions.

In this regard, it is to be understood that the above-mentioned settings, including the angle of inclination $\alpha 2$ of the rotary atomizing head 33 in the range of from 50 to 80 degrees and the coating distance L2 between the coating surface of the vehicle body 12 and the marginal edge 33A of the rotary atomizing head 33 in the range of 5 mm to 20 mm, can be modified depending upon the outside diameter and rotational speed of the rotary atomizing head 33, the type and feed rate of paint or other conditions which influence the paint atomization behaviors.

Further, as the coating distance L2 from the marginal edge of the rotary atomizing head 33 to the coating surface of the vehicle body 12 approaches 10 mm, the flow rectification plate 36 comes closer to the coating surface of the vehicle body 12. Therefore, by the rectification plate 36, mist blocking air which is supplied from the air nozzle 35 is guided in a direction forward of the rotary atomizing head 33 in such a way as to target at the position of the border line BL to form streams of mist blocking air effectively.

Figure 13:
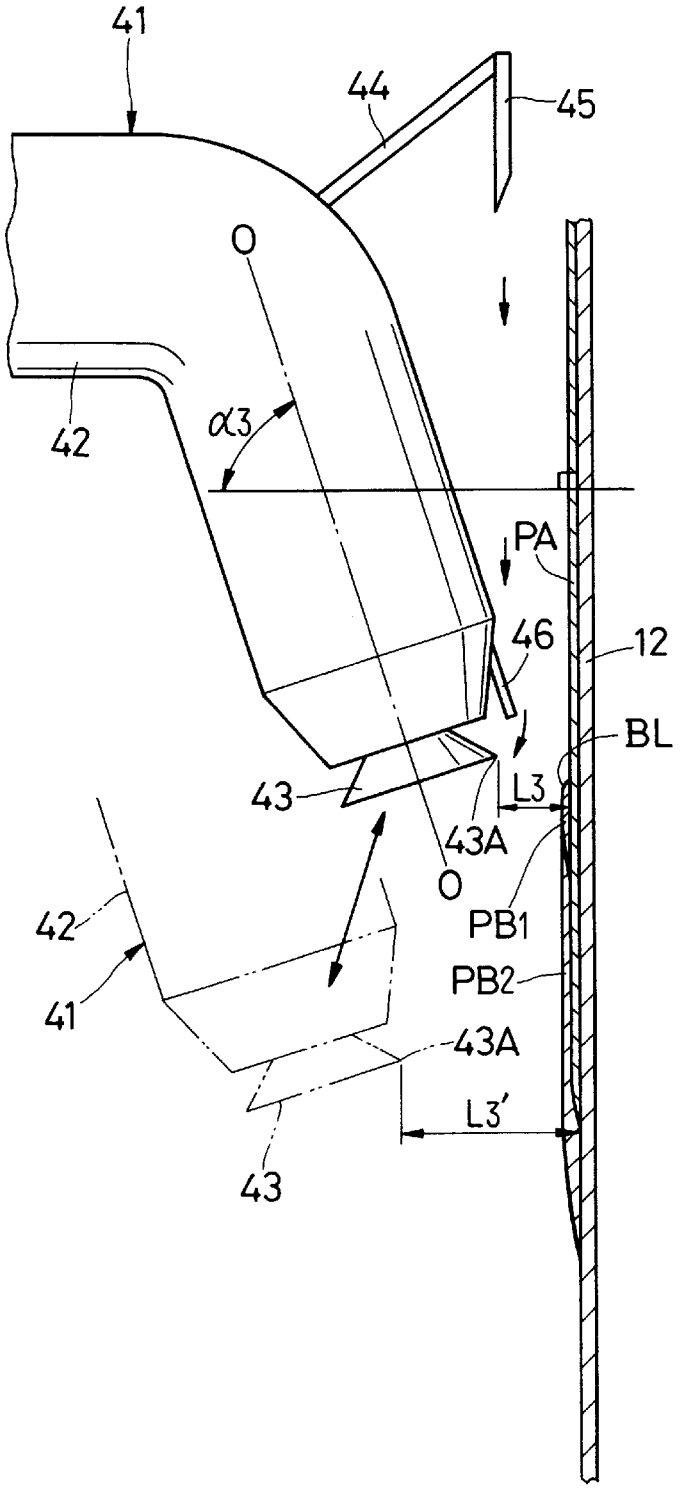
FIG. 13 is an enlarged schematic outer view of a part of the vehicle body and the rotary atomizing head type sprayer unit, which is in a stage of coating a belt zone.

Nextly, a belt zone coating stage is located on the downstream side of the border zone coating stage 3, and the belt zone coating stage 4 is employing a rotary atomizing head type sprayer unit 41 which is arranged in the manner as described below with reference to FIG. 13. Similarly to the sprayer unit 31 which is used in the border zone coating stage 3, the sprayer unit 41 is constituted by an assembly of a casing 42 and a rotary atomizing head 43, and provided with an air motor, a feed tube and shaping air outlet holes, which are not shown in the drawings, and can apply a high voltage to the paint. Further, an air nozzle 45 is provided at a distal end of a stay 44, and a flow rectification plate 46 is provided at a fore distal end portion of the casing 42.

Furthermore, similarly to the sprayer unit 31 of the border zone coating stage 3, the rotary atomizing head type sprayer unit 41 of the belt zone coating stage 4 has its rotary atomizing head 43 tilted downward (toward the belt zone c) by an inclination angle $\alpha 3$ which is in the range of from 50 to 80 degrees, for example, approximately 70 degrees. In this instance, as shown in FIGS. 13 and 15, the coating distance L3 between the coating surface of the vehicle body 12 and the marginal edge 43A of the rotary atomizing head 43 is in the range of from 5 mm to 40 mm, for example, set at approximately 10 mm on the side of the border zone coating PB1, but increased to a greater distance L3' when in a position which is spaced from the border zone coating PB1 in the downward direction as indicated by two-dot chain line. In this belt zone coating stage 4, mist blocking air is spurted out from the air nozzle 45 in a direction forward of the rotary atomizing head 43. In this stage, other shaping air is not used, or, if necessary, is used only in a small amount which will not interfere with mist blocking air. Further, in this stage, a voltage is not applied, or, if necessary, is applied only at a suppressed level of approximately −30 kv.

In this instance, by spraying paint from the sprayer unit 41 which is inclined by 70 degrees in a downward direction or toward the belt zone c, particles of the color B paint which are sprayed solely by centrifugal force of the rotary atomizing head 43 are allowed to deposit and settle down on the coating surface to form a belt zone (band-like) coating PB2 continuously on the lower side of the border zone coating PB1, without trespassing the border zone coating PB1 by rebounding on and scattering away from the coating surface.

Further, since the belt zone coating PB2 which is applied in the belt zone coating stage 4 has nothing to do with the formation of the border line BL, the rotary atomizing head can be set at a greater coating distance L3 in the range of from 5 mm to 40 mm as compared with the coating distance L2 in the border zone coating stage 3 which is in the range of from 5 mm to 20 mm. It follows that the belt zone coating PB2 can be applied over a broader area than the border zone coating PB1. In forming a remainder area coating PB3 in the succeeding remainder area coating stage 5 which will be described later, particles of the color B paint are securely prevented from flying across the belt zone coating PB2 and border zone coating PB1 and depositing on the color A coating PA because there is a large distance to the border line BL.

Furthermore, in the belt zone coating stage 4, other shaping air is not used, or, if necessary, it is used only in a suppressed amount which will not interfere with mist blocking flair. Particles of the color B paint which are sprayed by centrifugal force of the rotary atomizing head 43 deposit on the work object without being influenced by shaping air. Therefore, particles of the color B paint are prevented from being disturbed and scattered to deposit on the surface of color A coating PA.

Figure 14:
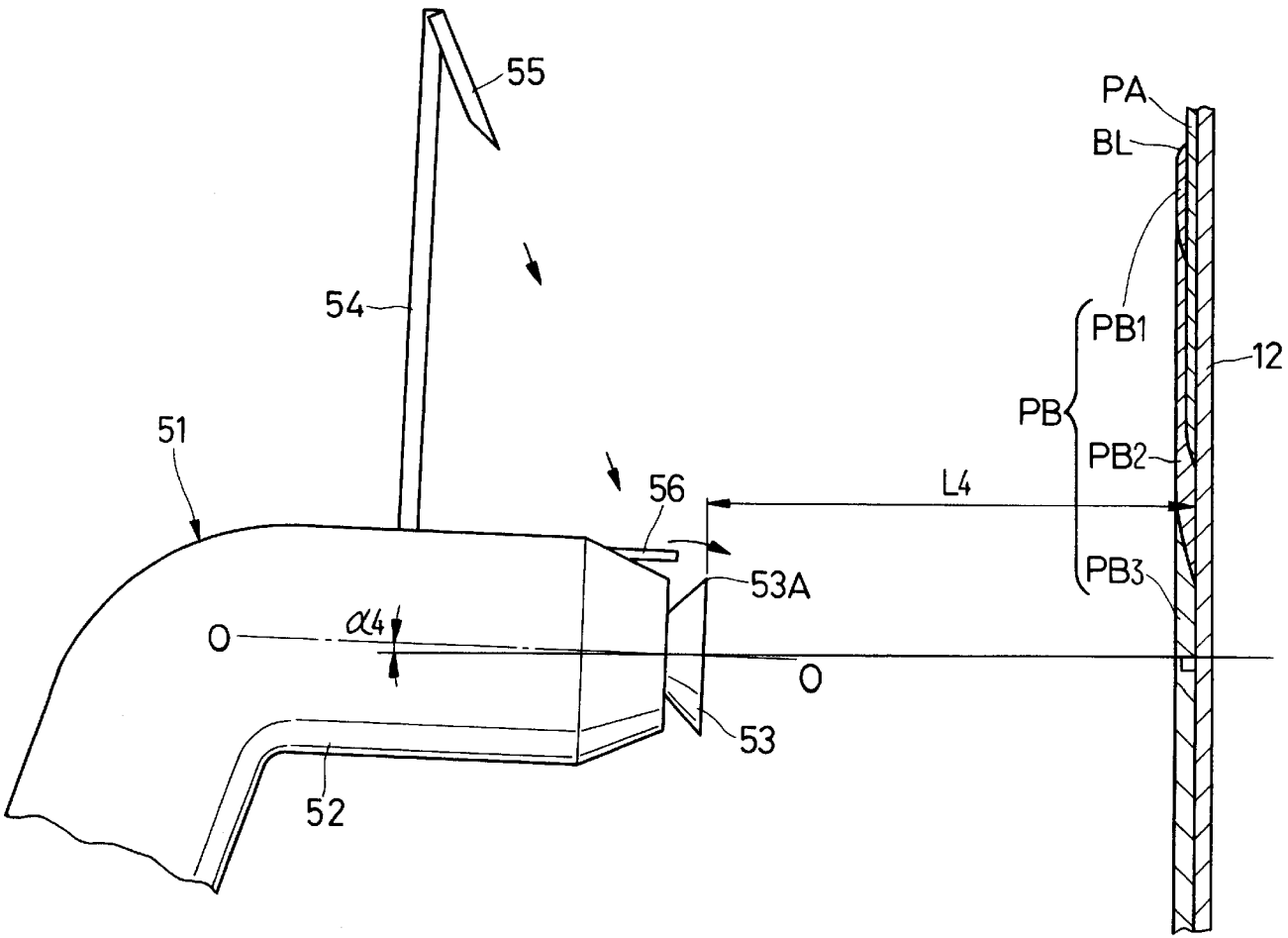
FIG. 14 is an enlarged schematic outer view of a part of the vehicle body and the rotary atomizing head type sprayer unit, which is in a stage of coating remainder portions of a coating area.

Nextly, a remainder area coating stage is located on the downstream side of the belt zone coating stage 4, and the remainder area coating stage 5 employs a rotary atomizing head type sprayer unit 51 which is arranged in the maimer as described below with reference to FIG. 14. Substantially similar to the sprayer unit 21 in the color A area coating stage 2, this sprayer unit 51 is constituted by an assembly including a casing 52, a rotary atomizing head 53, and provided with an air motor, a feed tube and shaping air outlet holes, which are not shown in the drawings, and is capable of applying high voltage to paint. Further, an air nozzle 55 is provided at a distal end of a stay 54, and a flow rectification plate 56 is provided on a fore end portion of the casing 52.

In the case of the rotary atomizing head type sprayer unit 51 of the remainder area coating stage 5, an inclination angle a4 of the rotary atomizing head 53 is set substantially at zero degrees. Therefore, even if the rotary atomizing head 53 is inclined slightly downward (toward a remainder area d), its inclination angle remains in the range of 1 to 10 degrees, for instance, at 2 degrees. Further, as shown in FIGS. 14 and 15, a coating distance L4 between the vehicle body 12 and marginal edge 53A of the rotary atomizing head 53 is set at a value in the range of from 100 mm to 350 mm, for example, at approximately 150 mm. Mist blocking air is supplied from the air nozzle at a suitable rate which is determined in relation with the width of the belt zone coating PB2, kind of paint and surface contour of the vehicle body 12. Further, similarly to the color A area coating stage 2, other shaping air is used and a high voltage of −30 kv to −120 kv is applied to paint in the remainder area coating stage 5.

In this remainder area coating stage 5 the sprayer unit 51 is tilted downward by approximately 2 degrees toward the remainder area d to spray paint in an opposite direction away from the color A coating PA; the coating distance L4 is set at a value in the range of 100 mm to 350 mm to position the sprayer unit at a smaller coating distance than the coating distance L1 (between 200 mm and 350 mm) in the color A area coating stage 2; and the rotary atomizing head 53 is provided with the air nozzle 55 and flow rectification plate 56 to spurt out mist blocking air from the air nozzle 55 in a direction forward of the rotary atomizing head 53 thereby preventing particles of the color B paint, which are sprayed by the rotary atomizing head 53, from flying over the belt zone coating PB2 and border zone coating PB1 and depositing on the surface of the color A coating PA.

Figure 16:
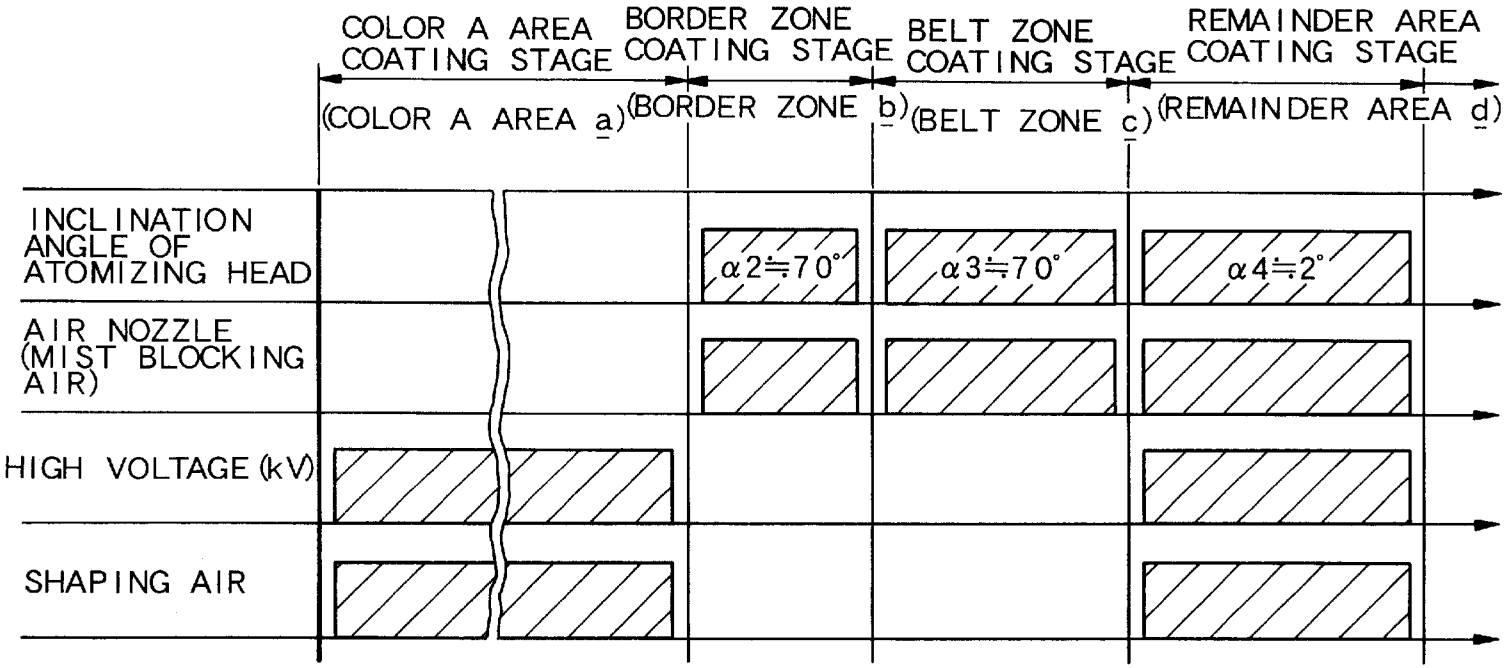
FIG. 16 is a time chart for the respective stages in the two-tone coating process.

Having the arrangements as described above, the two-tone coating apparatus according to the present embodiment of the invention is advantageously used for a two-tone coating operation in the manner as described below with reference to the time chart of FIG. 16 and the various operational phases illustrated in FIGS. 17 through 23.

Firstly, as soon as a vehicle body 12 on a support table 11A of the conveyer 11 is delivered to the coating plant 1, two-tone coating is started at the color A area coating stage or a first color coating stage 2 by coating a color A area of the vehicle body 12 with color A paint.

In the color A area coating stage, for example, an upper half of the vehicle body 12 is coated with color A paint. More specifically, as shown in FIG. 4, the robot arms 15B and 15C of the coating robot 15 in the color A area coating stage are put in action to position the rotary atomizing head 23 of the sprayer unit 21 substantially at right angles with respect to the coating surface of the vehicle body 12. Besides, the sprayer unit 21 is controlled to maintain a constant coating distance L1 in the range of 200 mm to 350 mm, while supplying shaping air to the sprayer unit and applying color A paint a high voltage in the range of −30 to −120 kv.

In this state, color A paint is supplied to the rotary atomizing head 23 from the feed tube and sprayed toward the vehicle body 12 by the rotary atomizing head 23. Whereupon, as shown in FIG. 4, color A paint particles which are charged with a high voltage deposit on the surface of the vehicle body 12 to form a color A coating PA thereon. At this time, by means of the tracking apparatus 13 and coating robot 15, the sprayer unit 21 is moved along in a reciprocating pattern up and down across the upper half of the vehicle body 12 to coat the color A paint on a color A area a which spreads to the lower side of a border line BL as exemplified by way of a left rear door 12D in FIG. 17. However, if desired, the color A paint may be coated on the entire vehicle body 12 in this color A area coating stage.

After forming the color A coating PA on the upper half of the vehicle body 12 in the color A area coating stage, the vehicle body 12 is transferred to the next border zone coating stage. In the border zone coating stage, the inclination angle α2 is set at approximately 70 degrees to tilt the rotary atomizing head 33 downward (toward the border zone b), and the coating distance L2 is set at approximately 10 mm. In addition, mist blocking air is spurted out from the air nozzle 35 toward the flow rectification plate 36 to supply same forward of the rotary atomizing head 33. In this stage, neither supply of other shaping air nor application of high voltage is required.

Further, in the border zone coating stage using color B paint, the border zone b is painted by the so-called wet-on-wet coating, before baking the color A coating PA in a furnace, namely, while the color A coating PA which was applied in the preceding color A area coating stage is still in a wet state.

Then, the color B paint is supplied to the rotary atomizing head 33 from the feed tube, whereupon the color B paint is sprayed in an atomized form solely by the centrifugal force of the rotary atomizing head 33 which is put in high speed rotation. As shown in FIG. 5, sprayed particles of the color B paint deposit and settle on the border zone b without rebounding on the coating surface and partly overlapping with the color A coating PA, since the paint particles are sprayed at a point where they are still in the form of a converged flux, which would spread apart and scatter beyond that point. Further, while forming the border zone coating PB1 on the border zone b as shown in FIG. 18, the sprayer units 31 are moved in step with the vehicle body 12 in the direction of transfer of the latter by the tracking apparatus 13 and 14 and coating robots 15 and 16. The border line BL is painted on in a clearly defined form by the border zone coating PB1.

Figure 19:
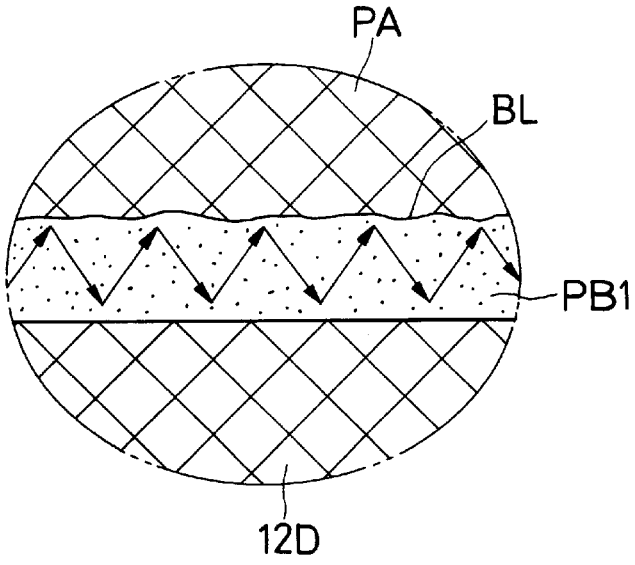
FIG. 19 is a schematic illustration showing on an enlarged scale a border zone which has been painted by reciprocating the rotary atomizing head up and down in a pattern across a border line.

In this instance, in the border zone coating stage, each sprayer unit 31 is moved in step with the vehicle body 12 in the transfer direction, and at the same time reciprocated up and down (in the vertical direction) across the width of the border line BL as indicated by arrows in FIG. 19. Accordingly, in the border zone coating stage, it is possible to increase the width of the border zone coating PB1 to a greater size to provide a broader safety zone which prevents particles of the color B paint from flying toward and reaching the color A coating PA in the succeeding belt zone coating stage.

Figure 21:
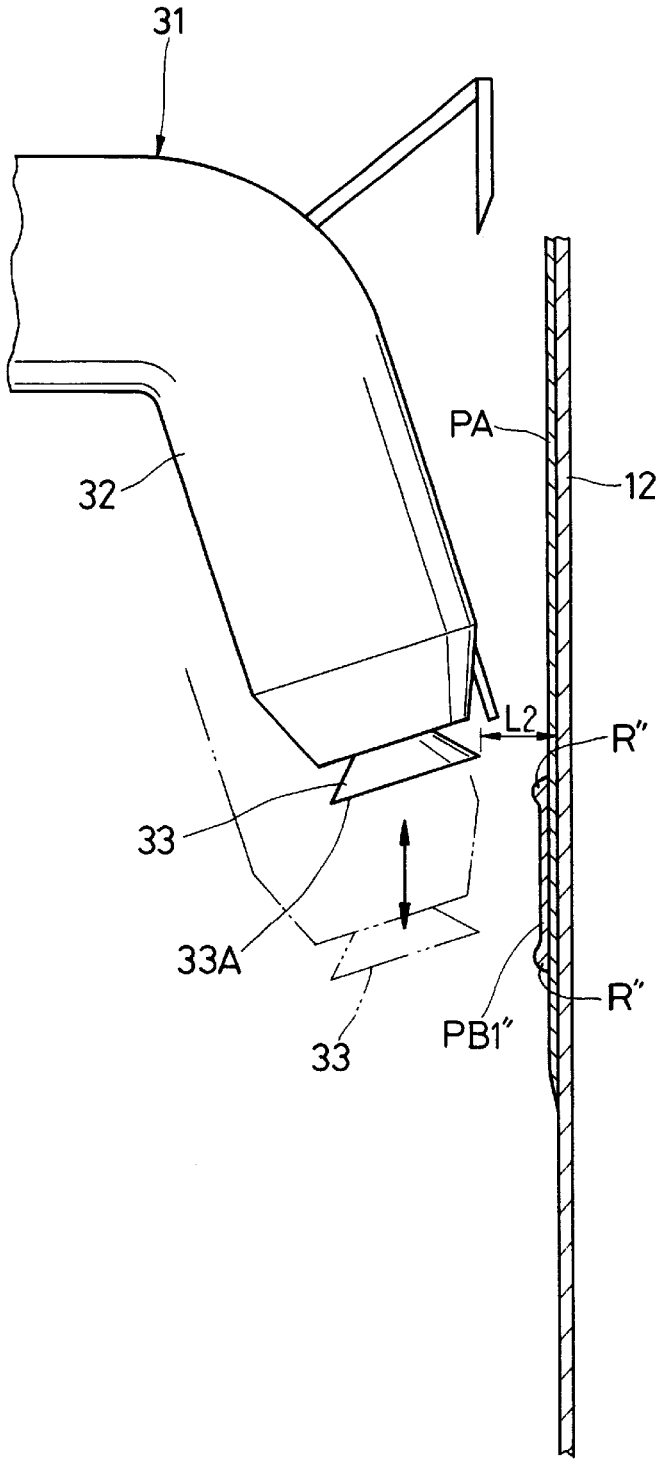
FIG. 21 is a schematic outer view of the sprayer unit of the comparative example which is put in a reciprocating coating pattern relative to a vehicle door.

In this connection, in a case where the sprayer unit 31 is reciprocated up and own while maintaining a constant coating distance L2 between the coating surface of the vehicle body and the marginal edge 33A of the rotary atomizing head 33 as exemplified in the comparative example shown in FIG. 21, the thickness of a border zone coating PB1 is increased at the upper and lower reversing ends R" where the movement of the sprayer unit 31 is slowed down.

However, according to the present embodiment of the invention, as shown in FIG. 5, while the sprayer unit 31 is put in upward and downward reciprocating motion, the marginal edge 33A of the rotary atomizing head 33 is located at a minimal coating distance L2 from the coating surface of the vehicle body 12 when in a position for coating the border line BL, and located at a greater distance L2' when in a position which is spaced downward from the border line BL as indicated by two-dot chain line. By controlling the operating position of the sprayer unit 31 in the manner as described above, the sprayer unit 31 is located at a smaller distance to the vehicle body 12 on the side of the border line BL of the border zone coating PB1 to define the border line BL with a thick and clear coating. On the other hand, when moved to a position away from the border line BL of the border zone coating PB1 in each cycle of reciprocating pattern, the sprayer unit 31 is located at a greater distance from the vehicle body 12 to apply a thinner coating which spreads over a broader area. Consequently, a flat and gradational coating is applied at positions away from the border line BL, namely, at a position where the belt zone coating PB2 will be overlapped. Therefore, the belt zone coating PB2 can be finished in favorable conditions even in overlapped portions.

Figure 20:
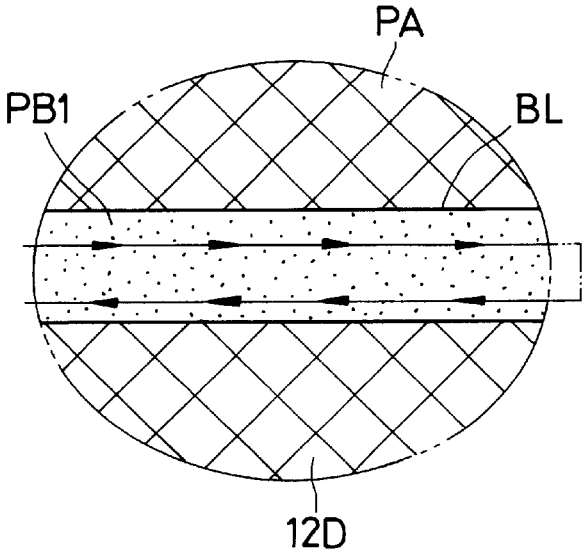
FIG. 20 is a schematic illustration showing on an enlarged scale a border zone which has been painted by reciprocating the rotary atomizing head back and forth in a pattern parallel with a border line.

In the border zone coating stage, if desired, the border zone coating PB1 may be applied by moving the rotary atomizing head 33 back and forth along the border line BL in a parallel pattern, successively shifting the coating position in the vertical direction at each reversing end as shown in FIG. 20.

Further, in the border zone coating stage, mist blocking air which is spurted out from the air nozzle 35 is guided in a direction forward of the rotary atomizing head 33 by means of the rectification plate 36 which is provided on a fore end portion of the casing 32. By this supply of mist blocking air, particles of the color B paint which are sprayed at the time of forming the border zone coating PB1 are prevented from scattering in the direction of the color A coating PA.

Furthermore, the suspension of the shaping air supply in the border zone coating stage is to eliminate a factor which disturbs the directionability of particles of the color B paint which is sprayed by the rotary atomizing head 33, thereby ensuring to paint the border line BL of the border zone coating PB1 in a clearer form.

The above border zone coating stage, coating of the border zone b under the color A coating PA, is followed by a belt zone coating stage. In the belt zone coating stage, similarly to the above-described border zone coating stage, the inclination angle α3 is set at about 70 degrees to tilt the rotary atomizing head 43 downward (toward the belt zone c), the coating distance L3 is set at about 10 mm, and mist blocking air is spurted out from the air nozzle 45. Further, other shaping air is not supplied or, if desired, is supplied only in a small amount which would not disturb the mist blocking air. Further, in this stage, a voltage is not applied or, if desired, is applied only at a suppressed level of approximately −30 kv.

In this state, the color B paint is supplied to the rotary atomizing head 43 from the feed tube, whereupon the color B paint is sprayed solely by centrifugal force of the rotary atomizing head 43 which is put in high speed rotation. At the same time, the sprayer unit 41 is moved along and relative to the border zone coating PB1 to paint on a belt zone coating PB2 on the belt zone c continuously from the border zone coating PB1 as shown in FIG. 22.

Similarly to the foregoing border zone coating stage, in the belt zone coating stage, the sprayer unit 41 is reciprocated up and down in vertical directions or in directions perpendicular to the border line BL. Further, as shown in FIG. 13, in relation with the up and down reciprocating movements, the sprayer unit 41 is located at a minimum coating distance L3 at the upper ends of the reciprocating movements or on the side of the border zone coating PB1 and at a maximum coating distance L3', which is larger than the coating distance L3, at the lower ends or on the opposite side away from the border zone coating PB1. This makes it possible to finish overlapped portions more favorably when a remainder area coating PB3 is painted on lower remainder areas continuously from the belt zone coating PB2, just in the same way as the border zone coating PB1.

The belt zone coating stage, painting the belt zone c continuously from the border zone coating PB1, is followed by a remainder area coating stage. In the remainder area coating stage, the inclination angle a4 of the rotary atomizing head 53 is set approximately at zero degrees as shown in FIG. 14, so that it remains in the range of 1 to 10 degrees, for instance, at 2 degrees, even if the rotary atomizing head 53 is tilted slightly in a downward direction (toward the remainder area d), and the coating distance L4 is set approximately at 150 mm. In addition, mist blocking air is spurted out from the air nozzle 55, and a high voltage in the range between −30 kv and −120 kv is applied to the color B paint.

In this state, paint is supplied to the rotary atomizing head 53 from the feed tube, whereupon the paint is sprayed by the rotary atomizing head 53 toward the vehicle body 12. Sprayed particles of the color B paint, which are charged with a high voltage, are urged to deposit on the surface of the vehicle body 12 to form the remainder area coating PB3 as shown in FIG. 14. At this time, as indicated by arrows in FIG. 23, the sprayer unit 51 is reciprocated up and down by the tracking apparatus and coating robots while painting the remainder area coating PB3 on the remainder area d continuously on the lower side of the belt zone coating PB2.

Thus, as shown in FIG. 3, the vehicle body 12 is now painted in two tones, i.e., the upper half and the lower half of the vehicle body 12 on the upper and lower side of the border line BL are painted in color A and color B, respectively, by forming the color A coating PA, border zone coating PB1, belt zone coating PB2 and the remainder area coating PB3 on the vehicle body 12 in the manner as described above.

After the above-described two-tone coating, a clear paint is coated on the surfaces of the vehicle body in a succeeding clear paint coating stage as shown in FIG. 1.

Upon completing the respective coating stages, the vehicle body which has been coated in two tones is transferred to a baking stage and put in a baking furnace to bake simultaneously the color A coating PA, which was applied in the color A area coating stage, the color B coatings PB which were applied in the border zone coating stage, belt zone coating stage and color B coating stage, and the clear coating which was applied in the clear paint coating stage.

As described above, according to the present invention, the sprayer unit 31 with the rotary atomizing head 33 is tilted with respect to a coating surface of a vehicle body 12 at the time of painting the border zone coating PB1, and the color B paint is sprayed by centrifugal force of the rotary atomizing head 33 to coat a clearly defined border line BL with the color B paint.

Consequently, the two-tone coating method according to the present embodiment permits to omit masking stages and thus to enhance productivity and reductions in cost. In addition, the method of the present invention, which does not require to hold a masking plate in contact with a coating surface as in the afore-mentioned Japanese Laid-Open Patent No. S58-58168, contributes to simplify the construction of coating equipment, and can be applied to quality finish coatings. Further, in the case of the afore-mentioned Japanese Laid Open Patent No. H11-57606 employing a binary fluid nozzle type spray gun (air brush gun), there has been a problem that a jet of paint hits against a coating surface of a work object and splashes of paint scatter around the coating surface. In contrast, according to the above-described embodiment of the invention, it is possible to deposit paint securely on a specified area on a coating surface of a work object without causing paint particles to rebound and scatter around, permitting the painting of a two-tone coating in a reliable manner without masking coating areas.

Further, the use of the rotary atomizing head type sprayer units 21, 31, 41 and 51 makes it possible to cope with coating operations of large paint outputs, and to atomize paint efficiently into fine particles even if the paint is of a highly viscous type. Therefore, broad surface areas of a vehicle body 12 can be painted within a shortened period of time and with a finish of high quality.

Furthermore, since the sprayer unit 31 is reciprocated up and down relative to a vehicle body at the time of coating the border zone b, the border zone coating PB1 can be formed over a wider range. Besides, in relation with the vertical reciprocating movements, the rotary atomizing head 33 is positioned at a short distance L2 from a coating surface on the side of the border line BL and at a longer distance L2' when in a lower position away from the border line BL. Therefore, the border zone coating PB1 is applied in a greater thickness on the upper side to paint the border line BL in a clearly defined form and to provide a coating of improved quality. On the other hand, the gradational application of the border zone coating PB1 permits giving a favorable finish to coatings by precluding stepped surface irregularities which would otherwise appear in those areas where the belt zone coating PB2 is applied in partially overlapped relation with the border zone coating PB1.

Further, similarly to the reciprocating movements in the stage of coating the border zone b, the sprayer unit 41 is also reciprocated vertically up and down at the time of coating the belt zone c, and at the same time it is positioned at a minimal coating distance L3 from the coating surface of the vehicle body on the side of the border zone coating PB1 and at a longer distance L3' when in a lower position away from the border zone coating PB1. This gradational coating of the belt zone c also permits giving a favorable finish to coatings even in those areas where the remainder area coating PB3 is applied continuously on the lower side of the belt zone coating PB2 in partially overlapped relation with the latter.

Further, the sprayer unit 31 in the border zone coating stage 3 is provided with the air nozzle 35, and mist blocking air is spurted out from the air nozzle 35 toward the flow rectification plate 36 which is provided on a fore distal end portion of the casing 32, there to guide mist blocking air in a direction forward of the rotary atomizing head 33. Consequently, mist blocking air stops particles of the color B paint from scattering and flying toward the color A coating PA to provide a coating which is further improved in quality. Similar operational effects can be obtained from the sprayer unit 41 of the belt zone coating stage 4 and the sprayer unit 51 of the remainder area coating stage 5.

Turning now to FIGS. 24 through 27, there is shown a second embodiment of the present invention, namely, a method for coating a work object in two tones, which is applicable particularly to a case where a border line of one coating area is painted on in an upwardly or downwardly shifted position on a vehicle body. In this case, the two-tone coating method includes a color A area coating stage, a border zone coating stage and a belt zone coating stage, omitting the remainder area coating stage as in the foregoing first embodiment. In the following description of the second embodiment, those component parts which are common or identical with the counterparts in the foregoing first embodiment are simply designated by common or same reference numerals or characters to avoid repetitions of the same explanations.

According to the present embodiment, a color A area coating stage, a border zone coating stage and a belt zone coating stage employ the rotary atomizing head type sprayer units 21, 31 and 41, respectively, which are the same as the sprayer units which are employed in the corresponding coating stages of the foregoing first embodiment.

Figure 24:
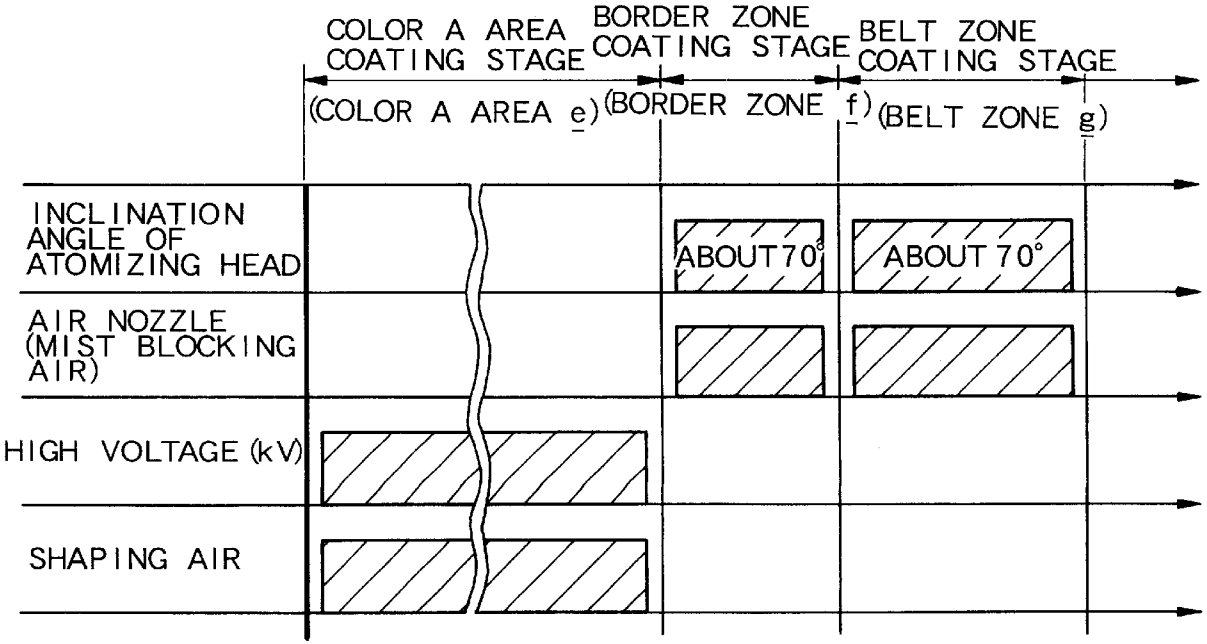
FIG. 24 is a time chart of a two-tone coating operation according to a second embodiment of the present invention.
Figure 26:
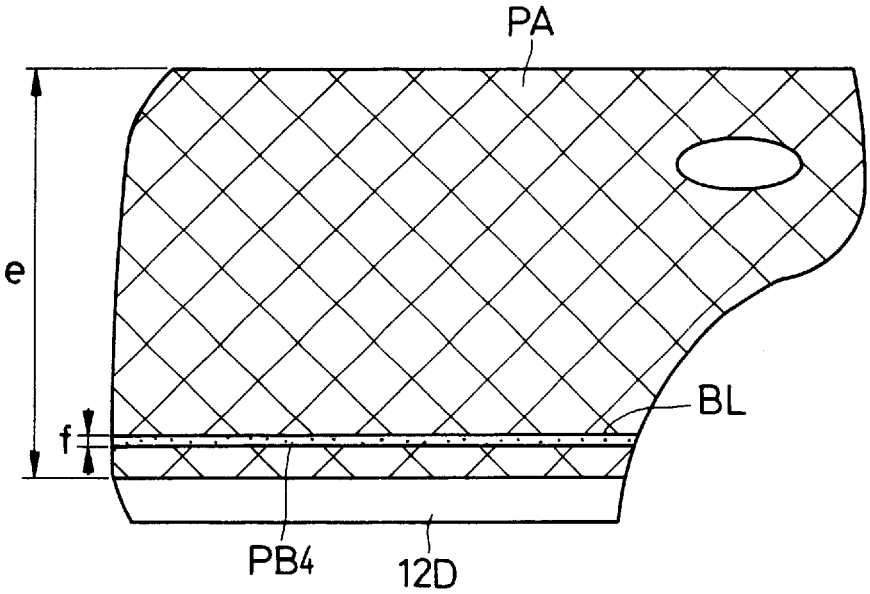
FIG. 26 is a schematic illustration of a border zone coating which is formed on a vehicle door in a border zone coating stage.
Figure 27:
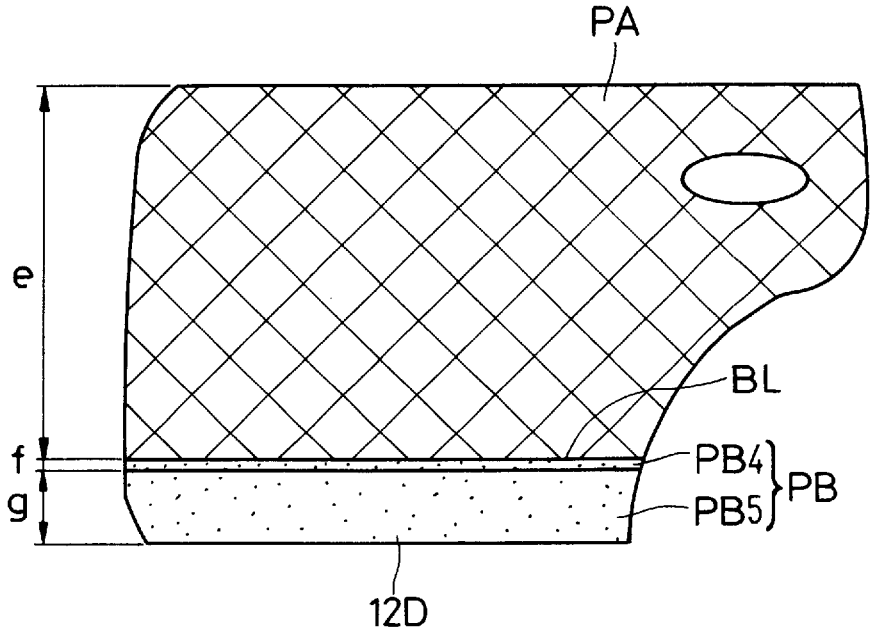
FIG. 27 is a schematic illustration of a belt zone coating which is formed on a vehicle door in a belt zone coating stage.
Figure 28:
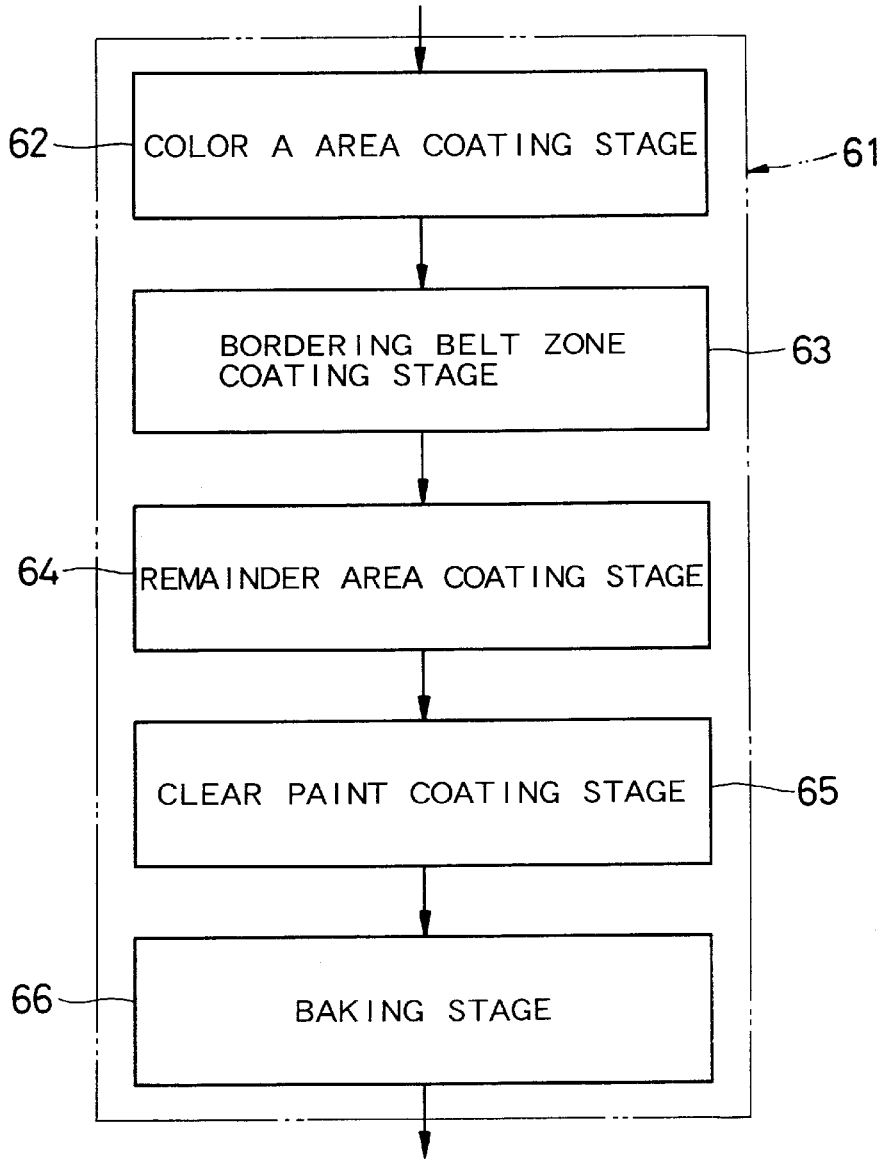
FIG. 28 is a block diagram of a two-tone coating method according to a third embodiment of the present invention.

Now, the two-tone coating method of the present embodiment is described below with reference to a time chart of FIG. 24 and to FIGS. 25 to 27 which schematically show operational steps or procedures of the two-tone coating.

Figure 25:
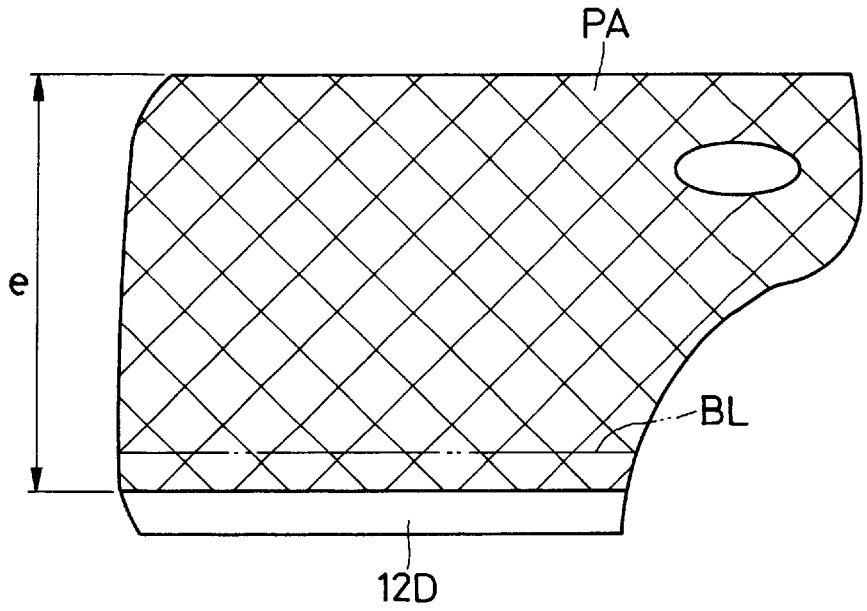
FIG. 25 is a schematic illustration of a color A area coating which is formed on a vehicle door in a color A coating stage.

Firstly, in the color A area coating stage, under the same coating conditions as in the corresponding coating stage in the foregoing embodiment, color A paint is coated on a color A area e down to a position lower than a border line BL as indicated by a two-dot chain line in FIG. 25 which shows by way of example a left rear door 12D.

In the case of the present embodiment, a border line BL is set at a lower position as compared with the border line BL in the foregoing first embodiment. Therefore, in this case, a color B coating PB is applied on a narrower surface area as described hereinlater.

The application of the color A coating PA on a vehicle body 12 in the color A area coating stage is followed by a border zone coating stage. In this border zone coating stage, under the same coating conditions as in the border zone coating stage in the foregoing first embodiment, a border zone f is painted as shown in FIG. 26. As a result, a border line BL is defined beneath the color A coating PA by a border zone coating PB4.

The application of the border zone coating PB4 beneath the color A coating PA in the above border zone coating stage is followed by a belt zone coating stage. In this belt zone if coating stage, under the same coating conditions as in the belt zone coating stage of the foregoing first embodiment, remaining surface areas, namely, belt zone g is painted continuously from the border zone coating PB4 as shown in FIG. 27 to form a belt zone coating PB5 on a lower portion of the vehicle body 12.

After forming the color A coating PA and color B coatings PB including the border zone coating PB4 and the belt zone coating PB5 on the vehicle body 12 in the manner as described above, a clear paint is coated on the vehicle body in a succeeding clear paint coating stage, and then the coated color A paint, color B paint and clear paint are baked simultaneously in a next paint baking stage.

As described above, the two-tone coating method according to the present embodiment, which is applicable under certain conditions of two-tone coating, for instance, applicable to a case where a color B area is a narrow one and its border line is located at a low position, comprises only two coating stages for color B painting, i.e., the border zone coating stage and the belt zone coating stage, omitting the remainder area coating stage as in the foregoing first embodiment, and therefore permitting to complete two-tone coating by a reduced number of steps.

Turning now to FIGS. 28 through 33, there is shown a third embodiment of the present invention. According to this embodiment, a coating area in a border zone coating stage is broadened, and a border zone coating stage and a belt zone coating stage are combined into one bordering belt zone coating stage, completing color B painting by the bordering belt zone coating stage and a remainder area coating stage.

In the drawings, indicated at 61 is a coating plant according to the present embodiment, having, along a coating line, a color A area coating stage 62 for painting a color A area, a bordering belt zone coating stage 63 for coating a bordering belt zone, a remainder area coating stage 64 for coating a remainder area, a clear paint coating stage 65 for coating a clear paint, and a baking stage 66 for baking coated paint.

In this instance, the color A area coating stage, the bordering belt zone coating stage and the remainder area coating stage employ rotary atomizing head type sprayer units 21, 31 and 51, respectively, which are the ones which are used in the color A area coating stage, border zone coating stage and remainder area coating stage in the foregoing first embodiment.

Figure 29:
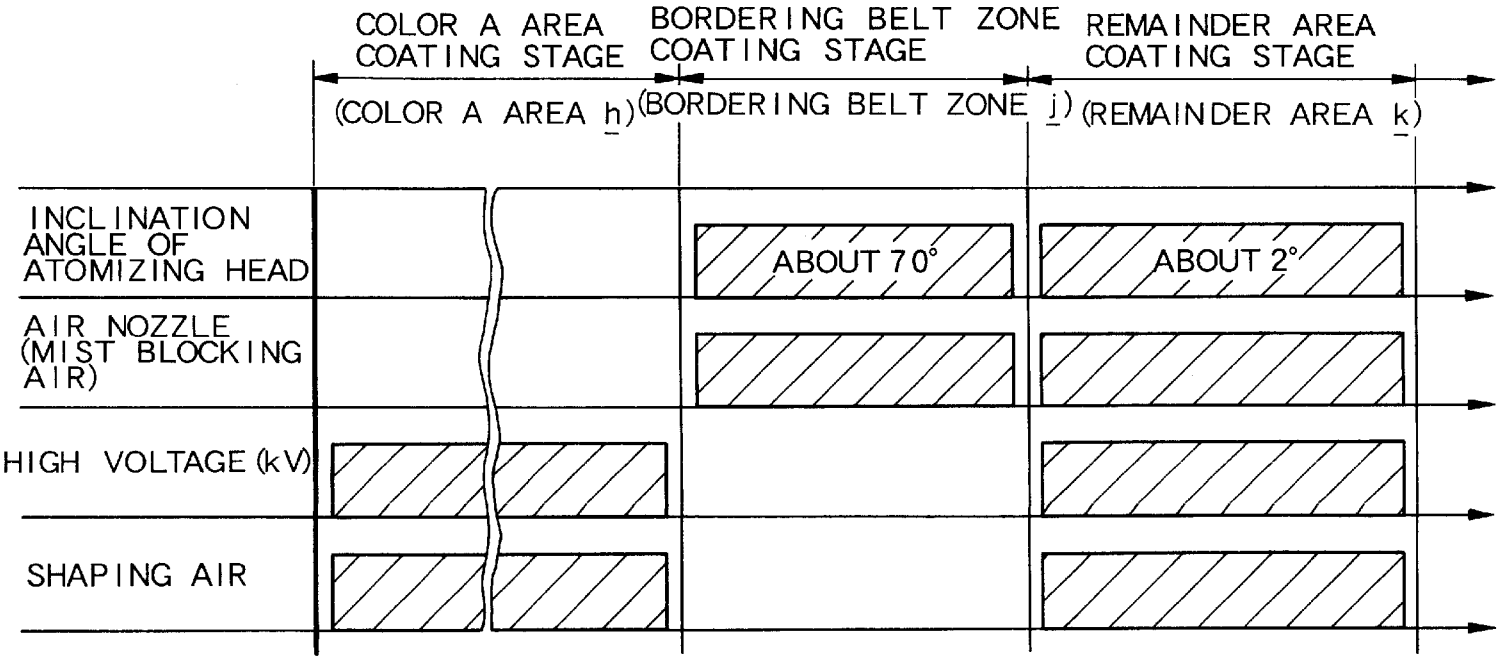
FIG. 29 is a time chart of a two-tone coating operation according to the third embodiment of the invention.

The two-tone coating method of the present embodiment is described more particularly below with reference to a time chart of FIG. 29 and also to FIGS. 30 to 33 which schematically show operational steps or procedures of the two-tone coating.

Figure 30:
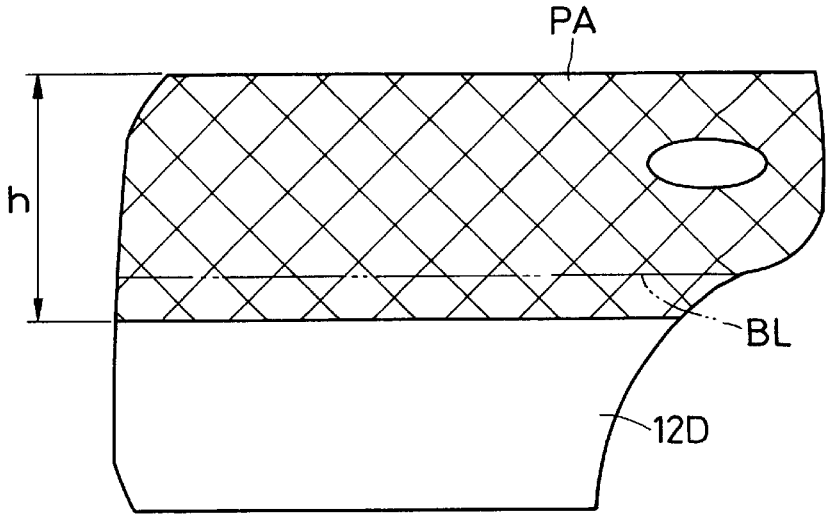
FIG. 30 is a schematic illustration of a color A coating which is formed on a vehicle door in a color A area coating stage.

Firstly, in the color A area coating stage, under substantially the same coating conditions as in the color A area coating stage of the foregoing first embodiment, color A paint is coated on a color A area h down to a position beneath a border line BL which is indicated by a two-dot chain line in FIG. 30 which shows by way of example a left rear door 12D of the vehicle body 12.

Figure 31:
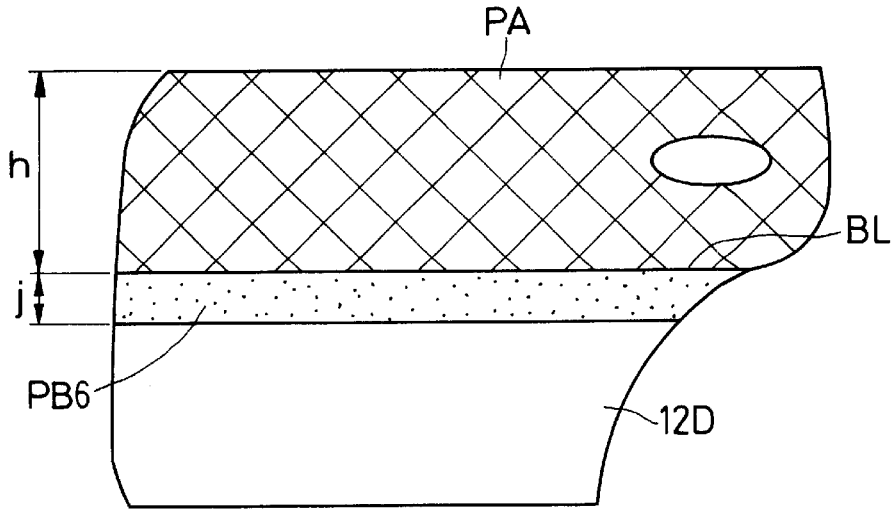
FIG. 31 is a schematic illustration of a bordering belt zone coating which is formed on a vehicle door in a bordering belt zone coating stage.

The application of a color A coating PA on an upper portion of the vehicle body 12 in the color A area coating stage is followed by a bordering belt zone coating stage. In this bordering belt zone coating stage, under substantially the same coating conditions as in the border zone coating stage in the foregoing first embodiment, paint is applied on the bordering belt zone j to form bordering belt zone coating PB6 as shown in FIG. 31.

Figure 32:
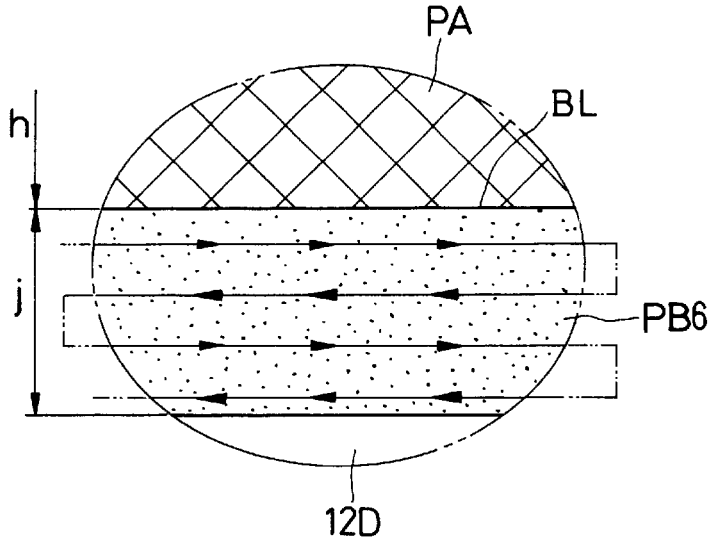
FIG. 32 is a schematic illustration showing on an enlarged scale a bordering belt zone coating which is formed by reciprocating a rotary atomizing head in a pattern parallel with a border line between two coating areas.

In this instance, in the bordering belt zone coating stage, as indicated by arrows in FIG. 32, the rotary atomizing head 33 is moved parallel with a border line BL and alternately in forward and backward directions a plural number of times, shifting its vertical position in an upward or downward direction at the end of each forward or backward movement. Accordingly, in the bordering belt zone coating stage, a bordering belt zone coating PB6 is applied over a broader area to provide a wider safe zone, which will prevent particles of the color B paint from scattering and flying toward the color A coating PA across the bordering belt zone coating PB6 in a next remainder area coating stage.

Figure 33:
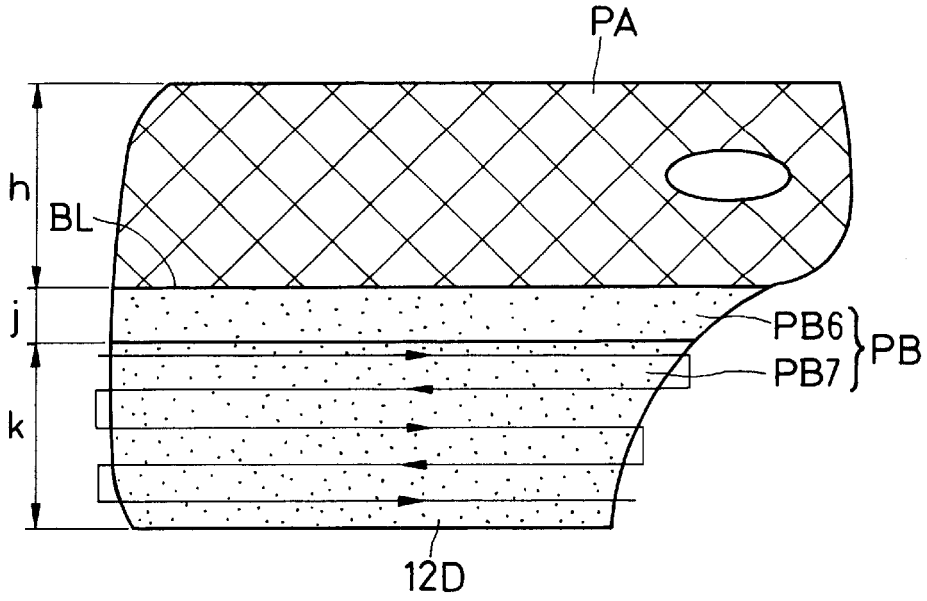
FIG. 33 is a schematic illustration showing a remainder area coating which is formed on a vehicle door in a remainder area coating stage.

The application of the bordering belt zone coating PB6 beneath the color A coating PA in the bordering belt zone coating stage is followed by a remainder area coating stage. In the remainder area coating stage, under substantially the same coating conditions, the rotary atomizing head 53 is moved parallel with the bordering belt zone coating PB6 and alternately in forward and backward directions (reciprocated) a plural number of times, shifting its vertical position at the end of each forward or backward movement as shown in FIG. 33. By so doing, a remainder area coating PB7 is formed on a remainder area k continuously under the bordering belt zone coating PB6.

After forming the color A coating PA, bordering belt zone coating PB6 and remainder area coating PB7 on the vehicle body 12 in the manner as described above, a clear paint is coated on the vehicle body in a succeeding clear paint coating stage, and then the coated color A paint, color B paint and clear paint are baked simultaneously in a next paint baking stage.

As described above, according to the present embodiment, a border line BL is defined by the bordering belt zone coating PB6 in the bordering belt zone coating stage. This bordering belt zone coating PB6 is applied over a broader area which corresponds, for example, approximately to the border zone coating PB1 plus the belt zone coating PB2 of the foregoing first embodiment. Namely, the bordering belt zone coating stage, which plays a double role of the border zone coating stage and the belt zone coating stage, makes it possible to reduce the number of steps of the two-tone coating operation and thus to cut the cost for the coating robots and sprayer units.

Further, the rotary atomizing head 33 is moved along a border line BL in the bordering belt zone coating stage. Accordingly, a smooth (rectilinear) border line BL can be painted by way of the bordering belt zone coating PB6 in a sharply defined form.

Figure 34:
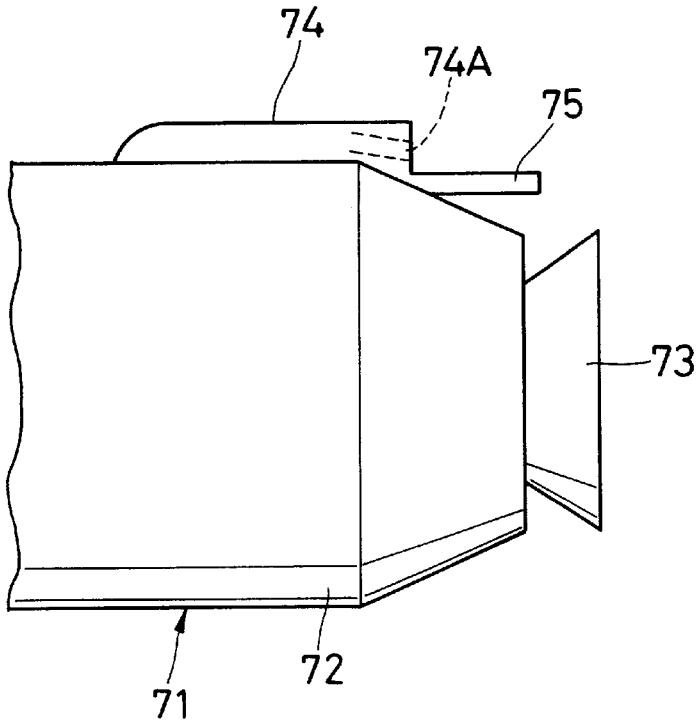
FIG. 34 is a schematic outer view of a rotary atomizing head type sprayer unit adopted in a modified embodiment of the present invention.
Figure 35:
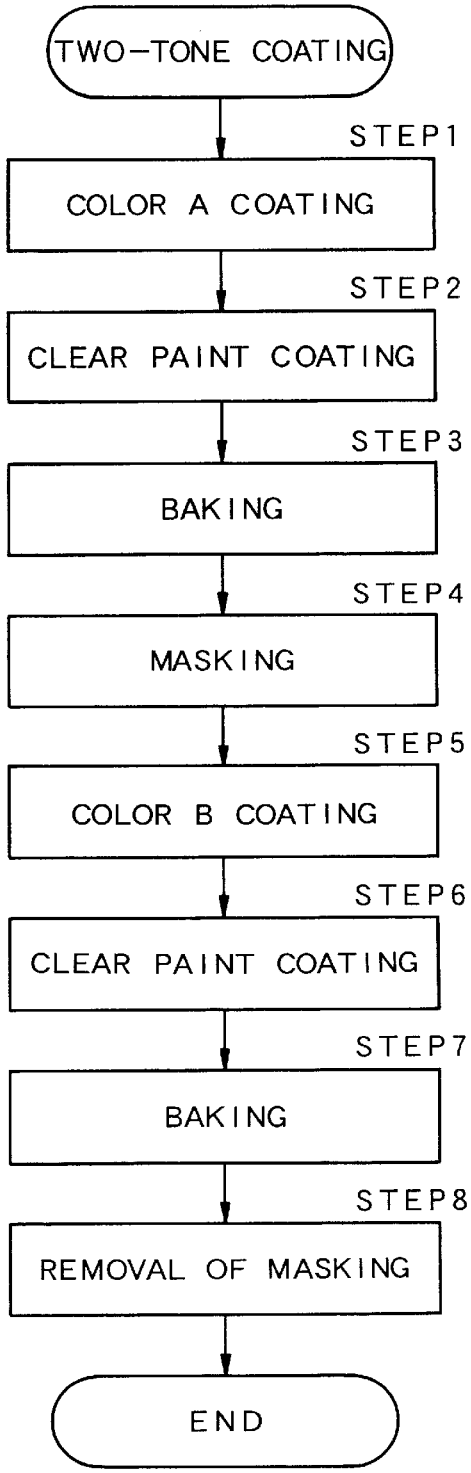
Fig. 35 PRIOR ART
FIG. 35 is a flow chart of a prior art two-tone coating method.
Figure 36:
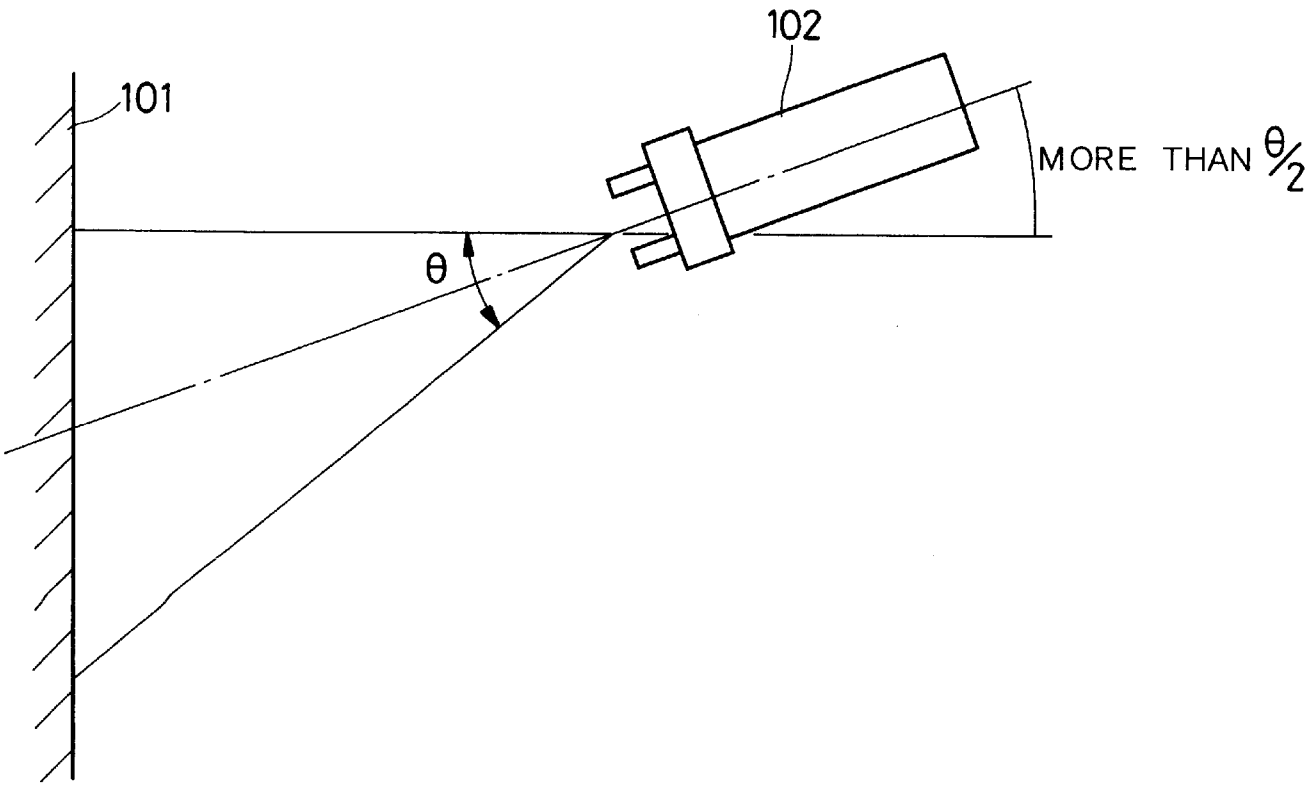
Fig. 36 PRIOR ART
FIG. 36 is a schematic outer view of a binary fluid nozzle spray gun employed in a two-tone coating method, mentioned hereinbefore as a second prior art.

In the foregoing first embodiment, the air nozzle 35 is provided on the sprayer unit 31 of the border zone coating stage 3, at a position which is spaced from the casing 32 through the stay 34. However, it is to be understood that the present invention is not limited to this particular arrangement. For example, as in the case of a modified rotary atomizing head type sprayer unit 71 shown in FIG. 34, it is possible to mount an air nozzle 74 with air outlet holes 74A directly on a casing 72, along with a flow rectification plate 75 which is provided integrally with the air nozzle 74. This modified air nozzle arrangement can be applied similarly to the sprayer unit 41 of the belt zone coating stage 4 and the sprayer unit 51 of the remainder area coating stage 5, not to mention the second and third embodiment of the present invention.

Further, in the foregoing first embodiment, the rotary atomizing head type sprayer units 21 and 51 are employed in the color A area coating stage and remainder area coating stage of a two-tone coating operation, respectively. However, according to the present embodiment, other types of sprayer units such as air spray nozzle type or hydraulic spray nozzle type may be employed in these coating stages in place of the sprayer units 21 and 51. Similarly, sprayer units of other types, for example, such as air spray nozzle type or hydraulic spray type may be employed in the color A area coating stage of the second embodiment, or in the color A area coating stage and remainder area coating stage of the third embodiment.

On the other hand, in the border zone coating stage of the first embodiment, the rotary atomizing head 33 is either reciprocated vertically up and down or reciprocated back and forth parallel with a border line BL a plural number of times, shifting its vertical position each time. Further, in the bordering belt zone coating stage of the third embodiment, the rotary atomizing head 33 is reciprocated back and forth a plural number of times in parallel relation with a border line BL. However, in the border zone coating stage in each one of the foregoing embodiments, arrangements may be made to form a border zone by moving the rotary atomizing head 33 once in a direction substantially parallel with a border line BL.

Furthermore, in the foregoing embodiments, the rotary atomizing head type sprayer units 21, 31, 41 and 51 are mounted on and moved by coating robots 15 and 16 to perform a predetermined coating operation. However, the present invention is not limited to this particular arrangement. For example, the sprayer units may be mounted on a reciprocator for rightward and leftward or upward and downward reciprocating movements.

What is claimed is:

1. A method for coating a work object in two tones, comprising:

[A] a first color coating stage for coating a first color area on a coating surface of said work object with first color paint;

[B] a border zone coating stage for coating a border zone with second color paint, by (1) positioning a rotary atomizing head of a sprayer unit at a predetermined distance to said work object and in an inclined state tilted toward said border zone, (2) supplying mist blocking air in a direction forward of said rotary atomizing head to block mist of said second color paint from scattering and flying toward a first color coating on said first color area, (3) without further supplying, in addition to the mist blocking air, shaping air that would further shape a spray pattern of said second color paint, (4) without applying high voltage to said second color paint, and (5) coating a border zone with said second color paint to paint a border line bounding on said first color area; and

[C] a belt zone coating stage for coating a belt zone with said second color paint, by (1) positioning a rotary atomizing head of a sprayer unit at a predetermined distance to said work object and in an inclined state tilted toward belt zone, (2) supplying mist blocking air in a direction forward of said rotary atomizing head to block mist of said second color paint from scattering and flying toward a first color coating on said first color area, (3) applying no high voltage to paint, and (4) coating said second color paint on said belt zone continuously from said border zone coating on said border zone by moving said rotary atomizing head in a reciprocating pattern.

2. A method for coating a Work object in two tones as defined in claim 1, wherein a coating is applied in said border zone coating stage, by (1) reducing a coating distance between a confronting marginal edge of said rotary atomizing head and said work object to a minimal value when said rotary atomizing head is in a coating position for painting said border line bounding on a first color coating on said first color coating area, (2) increasing said coating distance between said marginal edge of said rotary atomizing head and said work object when said rotary atomizing head is moved in a direction away from said border line, (3) while reciprocating said rotary atomizing head toward and away from said border line in a direction of intersecting the latter.

3. A method for coating a work object in two tones as defined in claim 1, wherein said rotary atomizing head is moved substantially parallel with said border line while painting a border zone area in said border zone coating stage.

4. A method for coating a work object in two tones as defined in claim 1, wherein a coating is applied in said belt zone coating stage, by (1) reducing a coating distance between a confronting marginal edge of said rotary atomizing head and work object to a minimal value on the side of a border zone coating, (2) increasing said coating distance between said marginal edge of said rotary atomizing head and said work object when said rotary atomizing head is moved in a direction away from said border zone coating, (3) while reciprocating said rotary atomizing head toward and away from said border line in a direction of intersecting the latter.

5. A method for coating a work object in two tones as defined in claim 1, wherein said rotary atomizing head is moved substantially parallel with said border line while painting said belt zone in said belt zone coating stage.

6. A method for coating a work object in two tones as defined in claim 1, wherein, in said belt zone coating stage, other shaping air is either not supplied at all or supplied in an amount that will not disturb said mist blocking air.

7. A method for coating a work object in two tones as defined in claim 1, wherein said rotary atomizing head of said sprayer unit is provided with an air nozzle adapted to spurt mist blocking air in a direction forward of said rotary atomizing head, said air nozzle being turned on to supply mist blocking air forward of said rotary atomizing head in said border zone coating stage and said belt zone coating stage.

8. A method for coating a work object in two tones as defined in claim 1, wherein said rotary atomizing head of said sprayer unit is provided with an air nozzle adapted to spurt mist blocking air in a forward direction toward said rotary atomizing head and a flow rectification plate for guiding mist blocking air from said air nozzle in a direction forward of said rotary atomizing head, said air nozzle being turned on to spurt out mist blocking air and supply same forward of said rotary atomizing head under the guidance of said flow rectification plate in said border zone coating stage and said belt zone coating stage.

9. A method for coating a work object in two tones as defined in claim 1, wherein, in said border zone coating stage and said belt zone coating stage, said rotary atomizing head is tilted through an angle in the range between 50 degrees and 80 degrees with respect a straight line normal to a coating surface of said work object.

10. A method for coating a work object in two tones as defined in claim 1, further comprising a baking stage for baking coatings of said first and second color paint simultaneously after completing coating operations of the respective coating stages.

11. A method for coating a work object in two tones, comprising:

[A] a first color coating stage for coating a first color area on a coating surface of said work object with first color paint;

[B] a border zone coating stage for coating a border zone with second color paint, by (1) positioning a rotary atomizing head of a sprayer unit at a predetermined distance to said work object and in an inclined state tilted toward said border zone, (2) supplying mist blocking air in a direction forward of said rotary atomizing head to block mist of said second color paint from scattering and flying toward a first color coating on said first color area, (3) without further supplying, in addition to the mist blocking air, shaping air that would further shape a spray pattern of said second color paint, (4) without applying high voltage to said second color paint, and (5) coating a border zone with said second color paint to paint a border line bounding on said first color area;

[C] a belt zone coating stage for coating a belt zone with said second color paint, by (1) positioning a rotary atomizing head of a sprayer unit at a predetermined distance to said work object and in an inclined state tilted toward said belt zone, (2) supplying mist blocking air in a direction forward of said rotary atomizing head to block mist of said second color paint from scattering and flying toward a first color coating on said first color area, (3) applying no high voltage to paint, and (4) coating said second color paint on said belt zone continuously from said border zone coating on said border zone by putting said rotary atomizing head in a reciprocating pattern; and

[D] a remainder area coating stage for coating said second color paint on remainder areas of said work object left subsequent to said belt zone coating stage.

12. A method for coating a work object in two tones as defined in claim 11, wherein a coating is applied in said border zone coating stage, by (1) reducing a coating distance between a confronting marginal edge of said rotary atomizing head and said work object to a minimal value when said rotary atomizing head is in a coating position for painting said border line bounding on a first color coating on said first color coating area, (2) increasing said coating distance between said marginal edge of said rotary atomizing head and said work object when said rotary atomizing head is moved in a direction away from said border line, (3) while reciprocating said rotary atomizing head toward and away from said border line in a direction of intersecting the latter.

13. A method for coating a work object in two tones as defined in claims 11, wherein said rotary atomizing head is moved substantially parallel with said border line while painting a border zone area in said border zone coating stage.

14. A method for coating a work object in two tones as defined in claim 11, wherein a coating is applied in said belt zone coating stage, by (1) reducing a coating distance between a confronting marginal edge of said rotary atomizing head and work object to a minimal value on the side of a border zone coating, (2) increasing said coating distance between said marginal edge of said rotary atomizing head and said work object when said rotary atomizing head is moved in a direction away from said border zone coating, (3) while reciprocating said rotary atomizing head toward and away from said border line in a direction of intersecting the latter.

15. A method for coating a work object in two tones as defined in claim 11, wherein said rotary atomizing head is moved substantially parallel with said border line while painting said belt zone in said belt zone coating stage.

16. A method for coating a work object in two tones as defined in claim 11, wherein, in said belt zone coating stage, other shaping air is either not supplied at all or supplied in an amount that will not disturb said mist blocking air.

17. A method for coating a work object in two tones as defined in claim 11, wherein said rotary atomizing head of said sprayer unit is provided with an air nozzle adapted to spurt mist blocking air in a direction forward of said rotary atomizing head, said air nozzle being turned on to supply mist blocking air forward of said rotary atomizing head in said border zone coating stage and said belt zone coating stage.

18. A method for coating a work object in two tones as defined in claim 11, wherein said rotary atomizing head of said sprayer unit is provided with an air nozzle adapted to spurt mist blocking air in a forward direction toward said rotary atomizing head and a flow rectification plate for guiding mist blocking air from said air nozzle in a direction forward of said rotary atomizing head, said air nozzle being turned on to spurt out mist blocking air and supply same forward of said rotary atomizing head under the guidance of said flow rectification plate in said border zone coating stage and said belt zone coating stage.

19. A method for coating a work object in two tones as defined in claim 11, wherein, in said border zone coating stage and said belt zone coating stage, said rotary atomizing head is tilted through an angle in the range between 50 degrees and 80 degrees with respect a straight line normal to a coating surface of said work object.

20. A method for coating a work object in two tones as defined in claim 11, further comprising a baking stage for baking coatings of said first and second color paint simultaneously after completing coating operations of the respective coating stages.

21. A method for coating a work object in two tones, comprising:

[A] a first color coating stage for coating a first color area on a coating surface of said work object with first color paint;

[B] a bordering belt zone coating stage for coating a bordering belt zone with second color paint, by (1) positioning a rotary atomizing head of a sprayer unit at a distance to said work object and in an inclined state tilted toward said border zone, (2) supplying mist blocking air in a direction forward of said rotary atomizing head to block mist of said second color paint from scattering and flying toward a first color coating on said first color area, (3) without further supplying, in addition to the mist blocking air, shaping air that would further shape a spray pattern of said second color paint, (4) without applying high voltage to said second color paint, and (5) coating a border zone with said second color paint to paint a border line bounding on said first color area;

[C] a remainder area coating stage for coating said second color paint on remainder area of said work object subsequent to said bordering belt zone coating stage.

22. A method for coating a work object in two tones as defined in claim 21, wherein a coating is applied in said bordering belt zone coating stage, by (1) reducing a coating distance between a confronting marginal edge of said rotary atomizing head and said work object to a minimal value when said rotary atomizing head is in a coating position for painting said border line bounding on a first color coating on said first color coating area, (2) increasing said coating distance between said marginal edge of said rotary atomizing head and said work object when said rotary atomizing head is moved in a direction away from said border line, (3) while reciprocating said rotary atomizing head toward and away from said border line in a direction of intersecting the latter.

23. A method for coating a work object in two tones as defined in claim 21, wherein said rotary atomizing head is moved substantially parallel with said border line while painting a border zone area in said bordering belt zone coating stage.

24. A method for coating a work object in two tones as defined in claim 21, wherein said rotary atomizing head of said sprayer unit is provided with an air nozzle adapted to spurt mist blocking air in a direction forward of said rotary atomizing head, said air nozzle being turned on to supply mist blocking air forward of said rotary atomizing head in said bordering belt zone coating stage.

25. A method for coating a work object in two tones as defined in claim 21, wherein said rotary atomizing head of said sprayer unit is provided with an air nozzle adapted to spurt mist blocking air in a forward direction toward said rotary atomizing head and a flow rectification plate for guiding mist blocking air from said air nozzle in a direction forward of said rotary atomizing head, said air nozzle being turned on to spurt out mist blocking air and supply same forward of said rotary atomizing head under the guidance of said flow rectification plate in said bordering belt zone coating stage.

26. A method for coating a work object in two tones as defined in claim 21, wherein, in said bordering belt zone coating stage, said rotary atomizing head is tilted through an angle in the range between 50 degrees and 80 degrees with respect a straight line normal to a coating surface of said work object.

27. A method for coating a work object in two tones as defined in claim 21, further comprising a baking stage for baking coatings of said first and second color paint simultaneously after completing coating operations of the respective coating stages.

* * * * *